US010367290B2

(12) United States Patent
Maesoba et al.

(10) Patent No.: US 10,367,290 B2
(45) Date of Patent: Jul. 30, 2019

(54) CONNECTOR DEVICE AND MALE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP); Kimiyasu Okumura, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/035,752

(22) Filed: Jul. 16, 2018

(65) Prior Publication Data

US 2019/0067863 A1 Feb. 28, 2019

(30) Foreign Application Priority Data

Aug. 29, 2017 (JP) ..... 2017-164005

(51) Int. Cl.
*H01R 13/436* (2006.01)
*H01R 13/422* (2006.01)
(Continued)

(52) U.S. Cl.
CPC ..... *H01R 13/4223* (2013.01); *H01R 13/4364* (2013.01); *H01R 13/4365* (2013.01);
(Continued)

(58) Field of Classification Search
CPC ..... H01R 13/4364; H01R 13/4538; H01R 13/4365; H01R 13/502
See application file for complete search history.

(56) References Cited

U.S. PATENT DOCUMENTS 5,437,558 A * 8/1995 Sakuraoka ..... H01R 13/631 439/140
6,846,191 B2 * 1/2005 Hobbs ..... H01R 13/4538 439/140

(Continued)

FOREIGN PATENT DOCUMENTS

JP 6-333629 12/1994

*Primary Examiner* — Felix O Figueroa
(74) *Attorney, Agent, or Firm* — Gerald E. Hespos; Michael J. Porco; Matthew T. Hespos

(57) ABSTRACT

A connector device (A) includes male terminal fittings (32) having tabs (34) projecting forward from terminal bodies (33), and a holder (18) for holding the terminal bodies (33). A cover (22) is mounted on the holder (18) and is slidable between a protection position for covering the tabs (34) and a retracted position retracted from the protection position to expose the tabs (34). A pushing portion (50) of a female connector (40) pushes the cover (22) from the protection position to the retracted position while connecting the connectors (10, 40). A locking projection (31) and a locking recess (51) are formed on the cover (22) and the female connector (40) and serve as locks to pull back the cover (22) from the retracted position to the protection position by being locked to each other in the process of separating the female connector (40) from the male connector (10).

6 Claims, 24 Drawing Sheets

(51) Int. Cl.

| | |
|---|---|
| ***H01R 13/453*** | (2006.01) |
| ***H01R 13/502*** | (2006.01) |
| ***H01R 13/629*** | (2006.01) |
| ***H01R 13/642*** | (2006.01) |
| *H01R 12/58* | (2011.01) |
| *H01R 13/11* | (2006.01) |

(52) U.S. Cl.
CPC ..... *H01R 13/4538* (2013.01); *H01R 13/502* (2013.01); *H01R 13/629* (2013.01); *H01R 13/642* (2013.01); *H01R 12/58* (2013.01); *H01R 13/113* (2013.01)

(56) References Cited

U.S. PATENT DOCUMENTS 8,075,351 B2 * 12/2011 Park ..... H01R 13/40 439/372
9,520,669 B2 * 12/2016 Gerwatowski ..... H01R 13/44
9,608,357 B1 * 3/2017 Sundarakrishnamachari ..... H01R 13/4534

* cited by examiner

CONNECTOR DEVICE AND MALE CONNECTOR

BACKGROUND

Field of the Invention

The invention relates to a connector device and a male connector.

Related Art

Japanese Unexamined Patent Publication No. H06-333629 discloses a connector device with a female connector and a male connector. The male connector includes a terminal holding member for holding a male terminal and a male housing for accommodating the terminal holding member. The male terminal includes a male tab projecting forward. The female connector includes a female housing with a cover for accommodating a female terminal. When the female housing is fit into a receptacle of the male housing to connect the male and female connectors, the male tab of the male terminal is received into the female terminal to be connected electrically.

In the above-described connector device, the male tab may interfere with an outer wall of the body to be fractured or broken as the terminal holding member is being inserted into a body. As a countermeasure, it is considered to mount the terminal holding member with a terminal protecting member slidable between a protection position and a retracted position and to move the terminal protecting member to the protection position in advance to protect the male terminal when the terminal holding member is accommodated into the body. The male tab projects from the front surface of the terminal protecting member when the terminal protecting member is slid to the retracted position.

In the process of connecting the male and female connectors, the female housing contacts the front surface of the terminal protecting member at the protection position to push the terminal protecting member from the protection position to the retracted position. Therefore the male tab is in a projecting state. The mating tab projecting from the terminal protecting member is inserted into the female housing to be connected to the female terminal.

However, when it is tried to connect the male and female connectors again after the male and female connectors in a connected state are separated, the male tab is exposed in the receptacle. Thus, the male tab may be broken by an external matter that may have entered the receptacle. To prevent this, the terminal protecting member at the retracted position needs to be pulled back to the protection position using a tool after the two connectors are separated.

The present invention was completed on the basis of the above situation and aims to improve workability.

This object is solved according to the invention by the features of the independent claims. Particular embodiments of the invention are subject of the dependent claims.

SUMMARY

This disclosure relates to a connector device, comprising a male connector with at least one male terminal fitting. The male terminal fitting has a tab projecting forward from a terminal body. The male connector further has a terminal holding portion that is capable of holding the terminal body. A cover is mounted on the terminal holding portion and is displaceable between a protection position for at least partly covering the tab and a retracted position displaced from the protection position to at least partly expose the tab. The connector device further has a female connector that is connectable to the male connector. At least one female terminal fitting forming is mountable in the female connector and is connectable to the tab by connecting the male connector and the female connector. The female connector further has at least one pushing portion that is configured to displace the cover from the protection position toward or to the retracted position in the process of connecting the female connector to the male connector. Locks are formed on the cover and the female connector and are configured to displace the cover from the retracted position toward or to the protection position by being locked to each other in the process of separating the female connector from the male connector.

The female connector may comprise at least one terminal accommodating portion configured to at least partly accommodate the female terminal fitting, and positioning portions may be formed on the cover and the terminal accommodating portion. The positioning portions may be configured to restrict relative displacements of the cover and the terminal accommodating portion in a direction intersecting a connecting direction by being at least partly fitting to each other in the process of connecting the male connector and the female connector.

The female connector further may include a terminal accommodating portion that is configured to accommodate the female terminal fitting. Additionally, positioning portions may be formed on the cover and the terminal accommodating portion. The positioning portions may be configured to restrict relative displacements of the cover and the terminal accommodating portion in a direction intersecting a connecting direction by being fit to each other in the process of connecting the male and female connectors. Accordingly, since the cover is assembled with the terminal holding portion holding the terminal body of the male terminal fitting, the male and female terminal fittings can be positioned and connected smoothly.

The positioning portion may comprise a frame at a front end part of the cover, and the pushing portion may function as a positioning portion by being fit to the frame.

The lock may comprise a locking projection formed on an inner surface of the frame and a locking recess formed in an outer surface of the pushing portion.

The lock of the cover and the lock of the female connector may allow relative displacements of the cover and the female connector in a separating direction and may be disposed in such a positional relationship to be lockable to each other by the relative displacements in the separating direction in a state where the male connector and the female connector are connected properly and the pushing portion may be in contact with the cover. Accordingly, even if dimensional tolerances and assembling tolerances of members constituting the male connector and the female connector are large, the locking portion of the cover and the locking portion of the female connector can be locked reliably when the connectors are separated. The invention also relates to a male connector connectable to a female connector that includes a pushing portion. The male connector includes at least one male terminal fitting having a tab projecting forward from a terminal body. The male connector also has a terminal holding portion capable of holding the terminal body and a cover to be mounted on the terminal holding portion. The cover is displaceable between a protection position for at least partly covering the tab and a retracted position displaced from the protection position to at least partly expose the tab. The pushing portion displaces the cover from the protection position to the retracted position in the process of connecting the female and male connectors. At least one lock is formed on the cover and is configured to displace the cover from the retracted position toward or to the protection position by being locked to a locking target portion of the female connector in the process of separating the female connector from the male connector.

The cover may have at least one positioning portion that can fit to a terminal accommodating portion accommodating a female terminal fitting in the female connector. The positioning portion is fit to the terminal accommodating portion to restrict a relative displacement of the cover with respect to the terminal accommodating portion in a direction intersecting a connecting direction in the process of connecting the male and female connectors.

The positioning portion may be a frame on a front of the cover. The frame functions as the positioning portion by having the pushing portion fit thereto. Thus, the structure can be simplified as compared to the case where the pushing portion and the positioning portion are at different locations.

A locking projection may be formed on an inner surface of the frame and may function as the lock by being locked to an outer surface of the pushing portion. Thus, the shape of the cover can be simplified as compared to the case where the positioning portion and the locking portion are at different locations.

The locking portion and the locking target portion allow relative displacements of the cover and the female connector in a separating direction and are disposed in such a positional relationship as to be lockable to each other by the relative displacements in the separating direction in a state where the male connector and the female connector are connected properly and the pushing portion is in contact with the cover. Accordingly, even if dimensional tolerances and assembling tolerances of members of the male and female connectors are large, the locking portion of the cover and the locking target portion of the female connector can be locked reliably when the connectors are separated.

According to the above, the female connector may displace or pull back the cover substantially at the retracted position to the protection position by the locking of the locks in the process of separating the female connector from the male connector. Moreover, if the lock of the cover and the locking target portion of the female connector are locked in the process of separating the female connector from the male connector, the cover may be displaced or pulled back from the retracted position to the protection position. Furthermore, since an operation of pulling back the cover from the retracted position to the protection position after the connectors are separated is not necessary, workability is excellent.

These and other features and advantages of the invention will become more apparent upon reading the following detailed description and accompanying drawings.

It should be understood that even though embodiments are described separately, single features may be combined to additional embodiments.

DETAILED DESCRIPTION

First Embodiment

Figure 1:
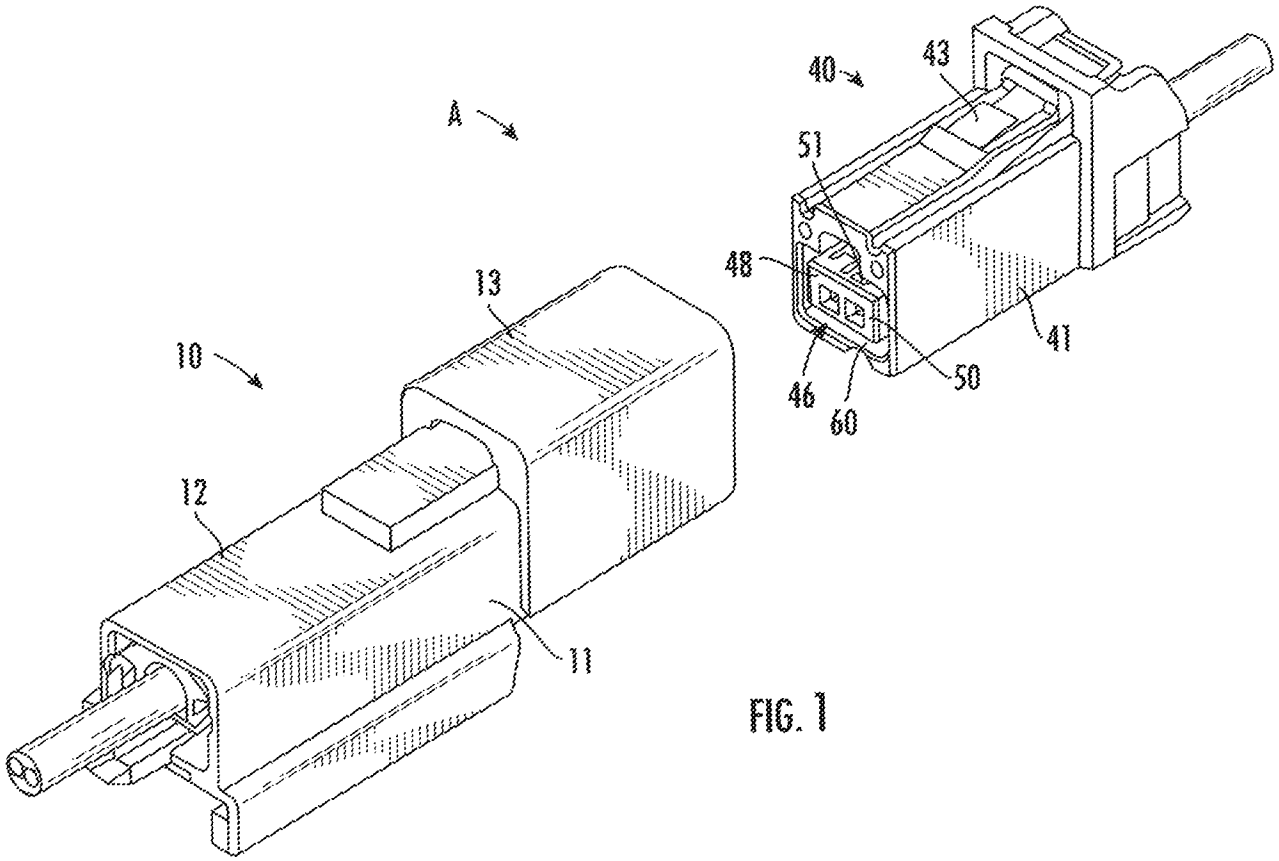
FIG. 1 is a perspective view showing a state where a male connector and a female connector are separated in a connector device of a first embodiment.
Figure 2:
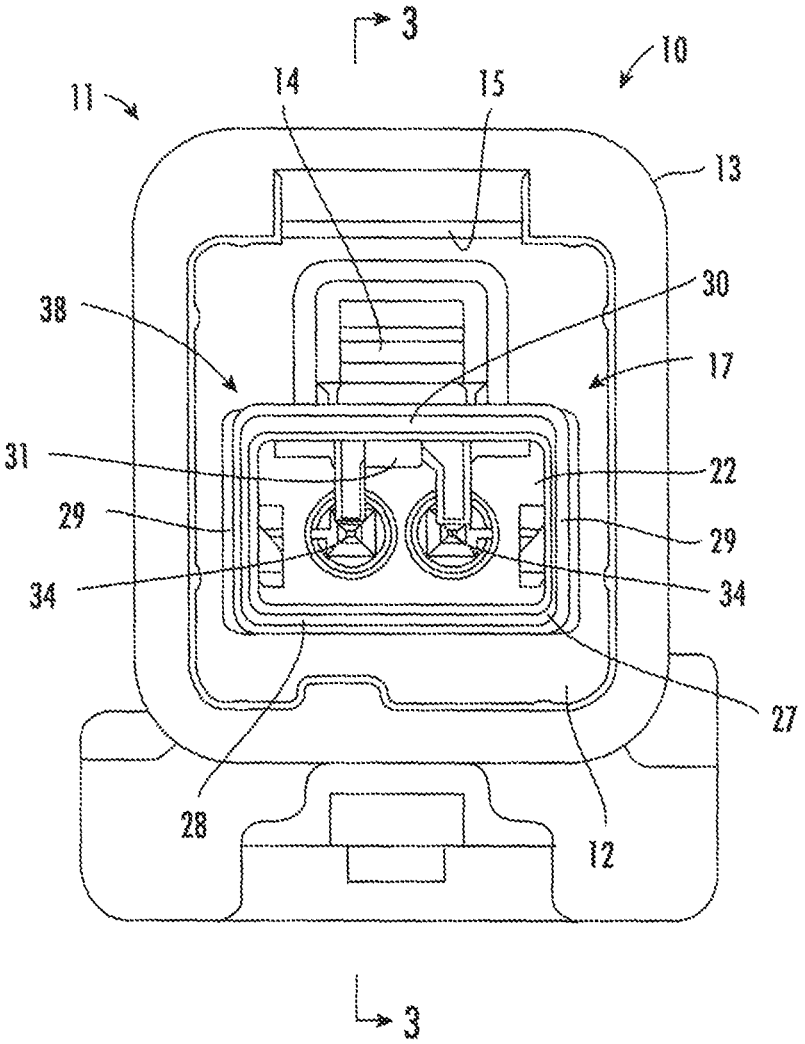
FIG. 2 is a front view of the male connector.
Figure 8:
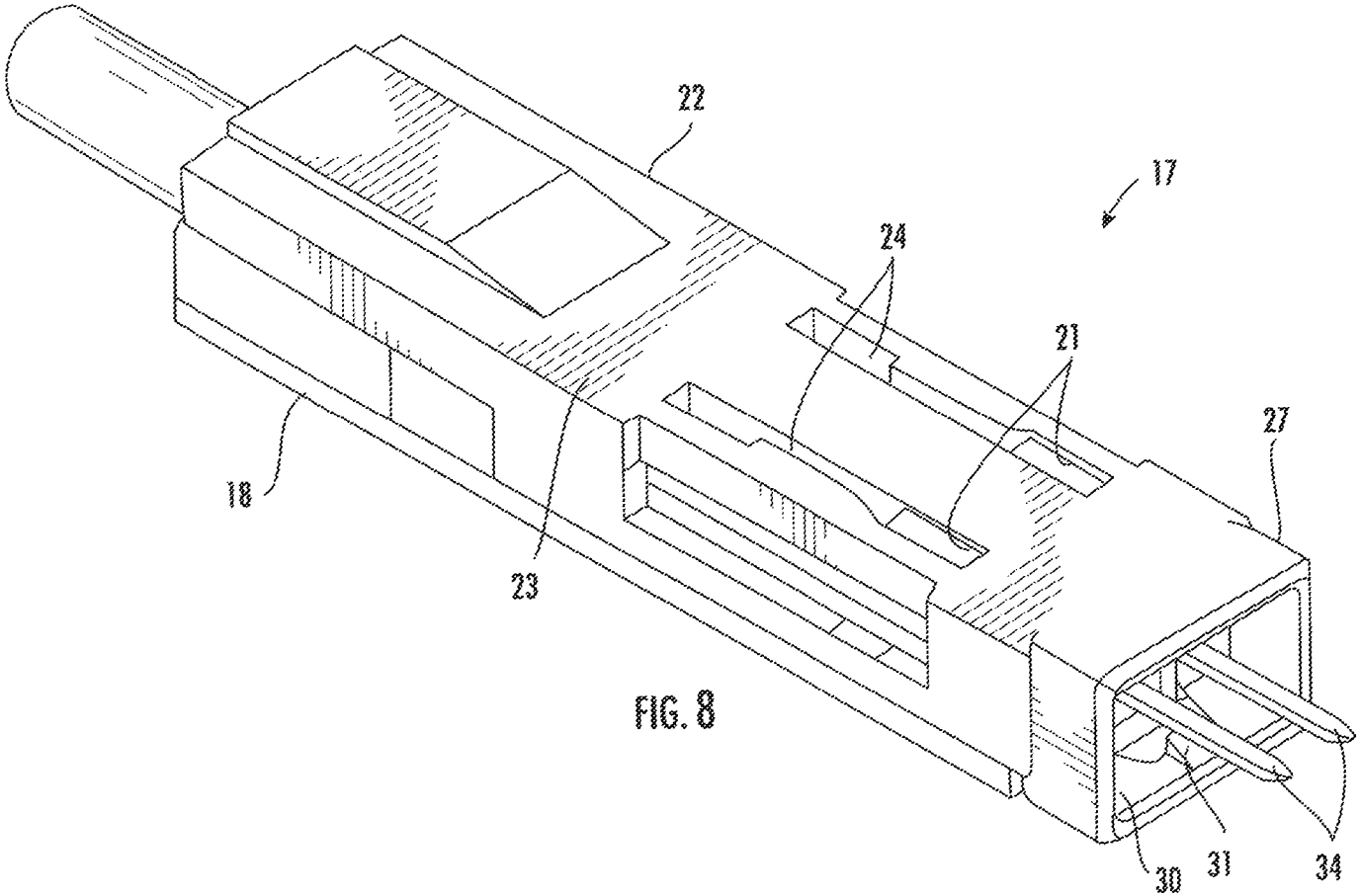
FIG. 8 is a perspective view of the male side dielectric showing a state where the cover is at a retracted position in a vertically inverted manner.
Figure 9:
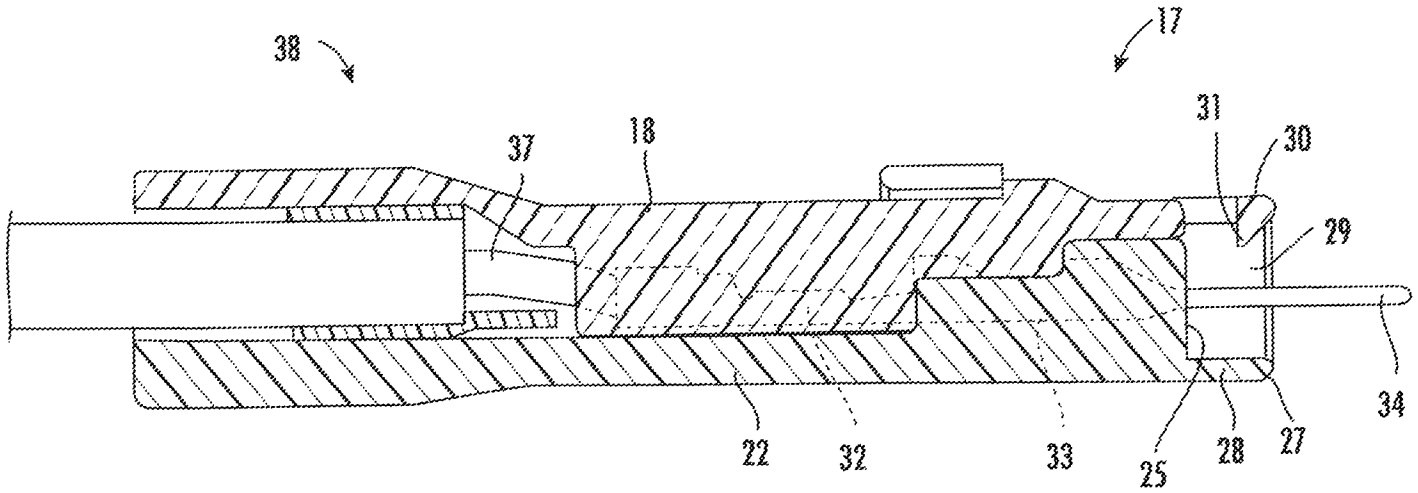
FIG. 9 is a section along Y-Y in the state where the cover is at the retracted position.
Figure 10:
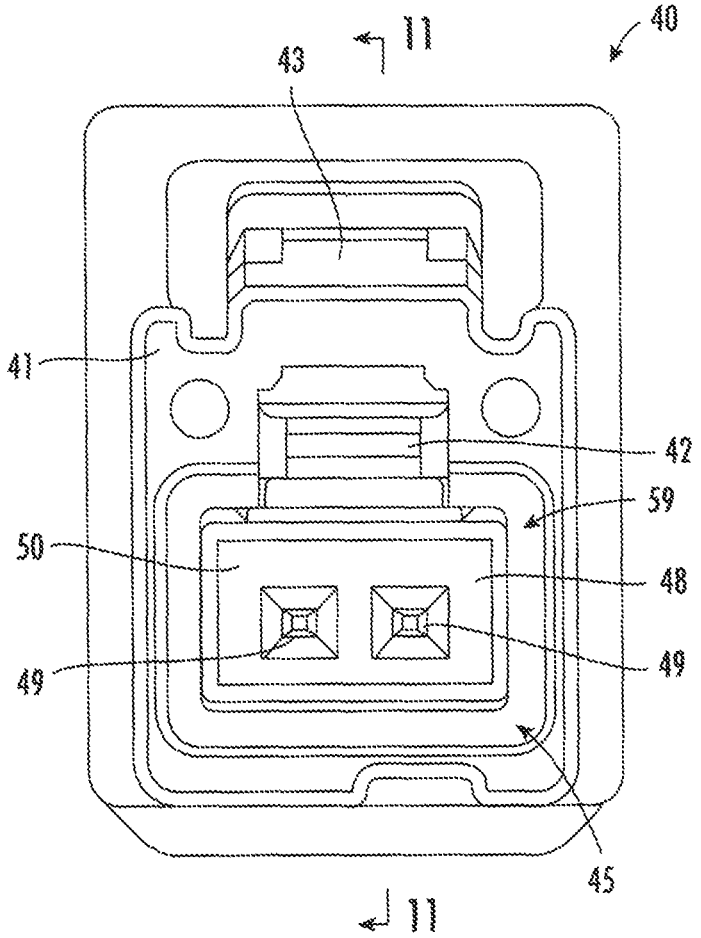
FIG. 10 is a front view of the female connector.

A specific first embodiment of the invention is described with reference to FIGS. 1 to 16. A connector device A of the first embodiment includes a male connector 10 and a female connector 40 connectable to and separable from each other with the front surfaces thereof facing each other. Note that, in the following description, a right side in FIGS. 1, 3, 4, 6 to 9 and 13 to 16 is defined as a front concerning a front-rear direction of the male connector 10. A left side in FIGS. 1 and 11 to 16 is defined as a front concerning a front-rear direction of the female connector 40. Upper and lower sides in FIGS. 1 to 16 are defined as upper and lower sides concerning a vertical direction. Left and right sides in FIGS. 2, 5 and 10 are defined as left and right sides concerning a lateral direction.

<Male Connector 10>

Figure 3:
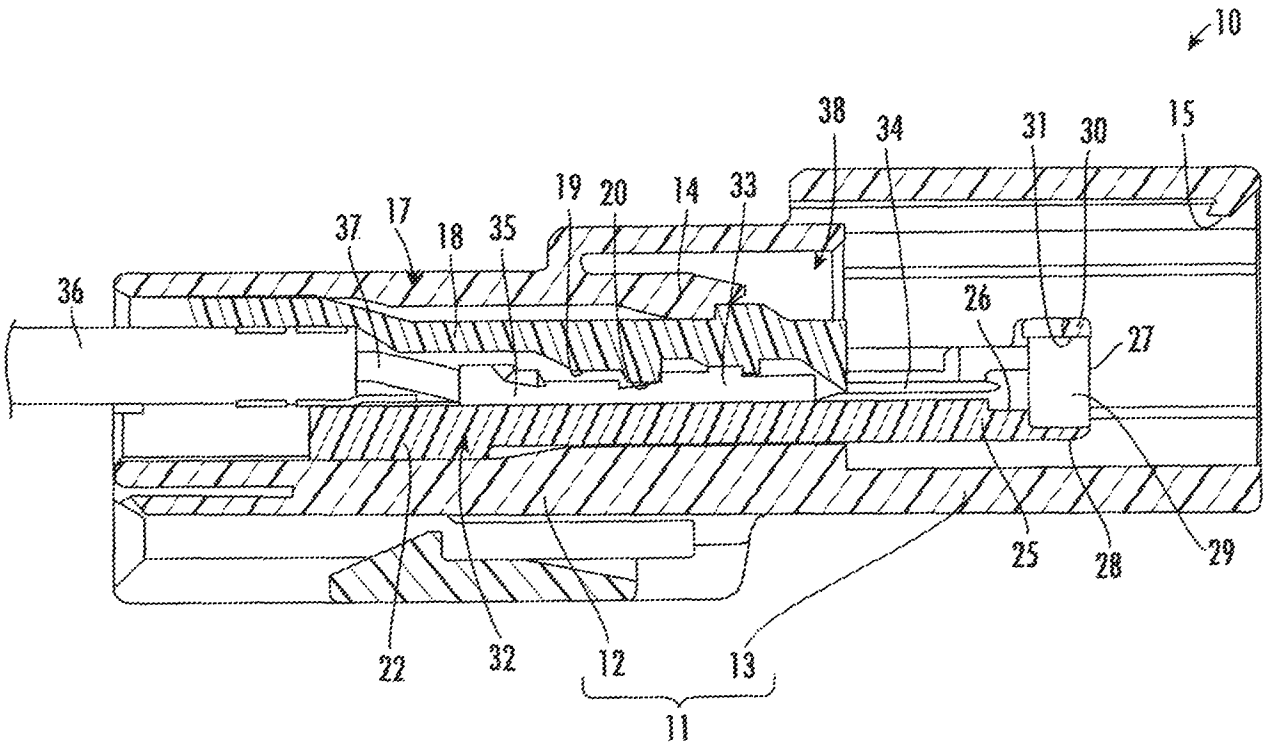
FIG. 3 is a section along X-X of FIG.

The male connector 10 is formed by assembling a male housing 11 made e.g. of synthetic resin, a male dielectric 17 and left and right male terminal fittings 32. As shown in FIG. 3, the male housing 11 is a single member including a male accommodating portion 12 and a receptacle 13 extending forward from the male accommodating portion 12. The male dielectric 17 is inserted into the male accommodating portion 12 from behind the male housing 11. A front stop (not shown) and a resiliently deflectable locking lance 14 are formed inside the male accommodating portion 12. A lock projection 15 is formed on the inner surface of a front part of an upper wall of the receptacle 13.

<Male Dielectric 17>

The male dielectric 17 is separate from the male housing 11 and is formed by assembling a holder 18 made of synthetic resin and a cover 22 made of synthetic resin. The holder 18 functions as a terminal holding portion for holding terminal bodies 33 of the male terminal fittings 32. As shown in FIGS. 4 to 9, the holder 18 is a rectangular plate long in the front-rear direction. Left and right holding grooves 19 are formed in the lower surface of the holder 18 (inner surface of the male side dielectric 17) and are long and narrow in the front-rear direction. Each holding groove 19 is formed with a holding fitting 20 composed of a step or a recess and a projection. Left and right plate-like restricting projections 21 are formed on a front part of the lower surface of the holder 18. The restricting projections 21 project down with a plate thickness direction aligned laterally.

As shown in FIGS. 4 to 9, the cover 22 is a box long in the front-rear direction and has open upper and rear surfaces. A lower wall 23 of the cover 22 is formed with left and right restricting grooves 24 that are long and narrow in the front-rear direction. The restricting grooves 24 are narrowed in substantially central parts in the front-rear direction. The cover 22 is assembled with the holder 18 from below, and the restricting projections 21 are fit in the restricting grooves 24 in an assembled state. The cover 22 assembled with the holder 18 is slidable in the front-rear direction between a protection position PP (see FIGS. 3, 4, 6, 7, 13 and 16) and a retracted position RP (see FIGS. 8, 9, 14 and 15) retracted rearward from the protection position PP.

Figure 4:
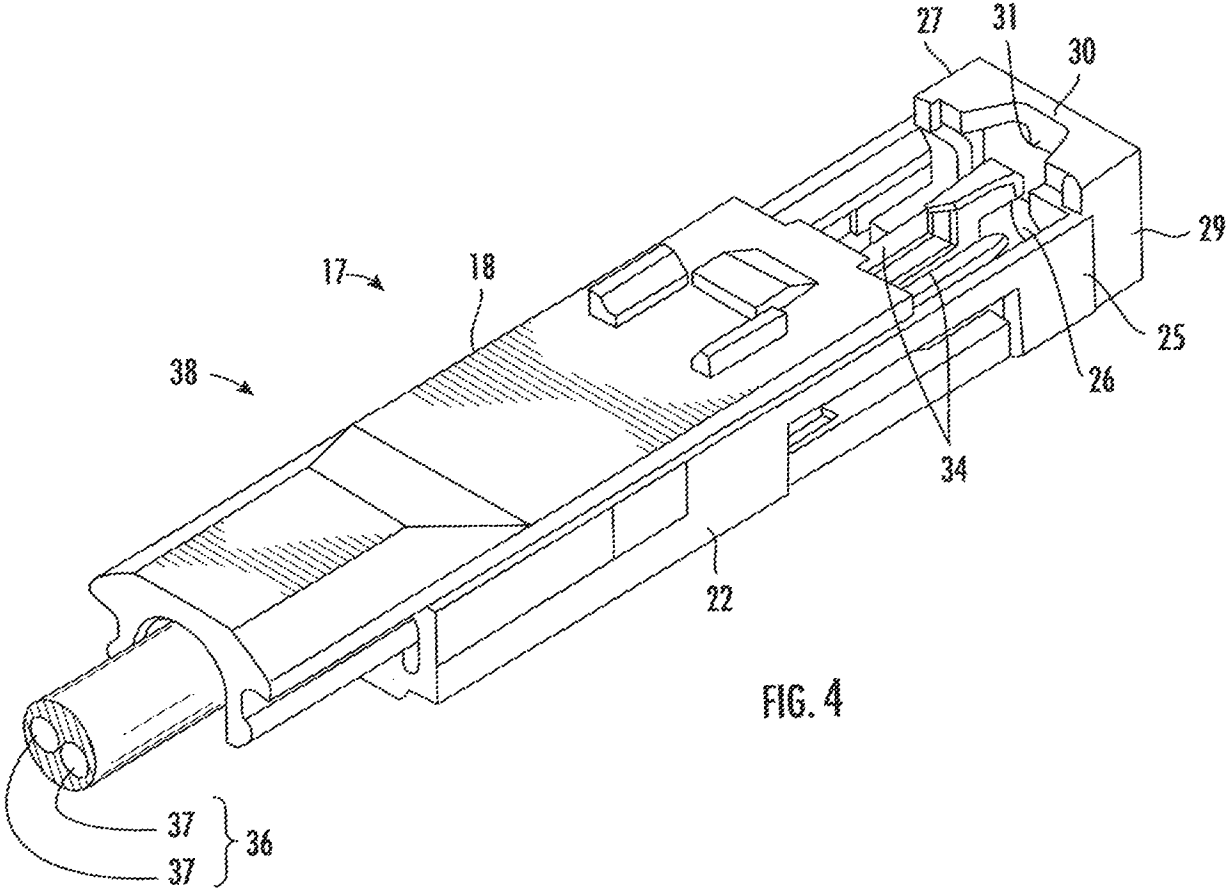
FIG. 4 is a perspective view of a male side dielectric showing a state where a cover is at a protection position.
Figure 5:
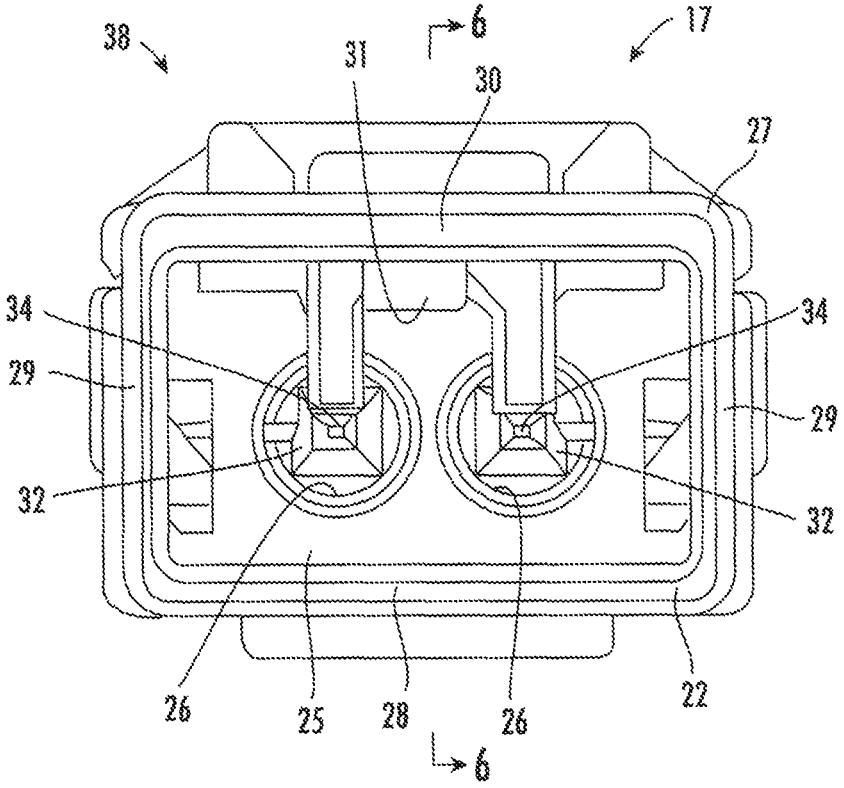
FIG. 5 is a front view of the male side dielectric.
Figure 6:
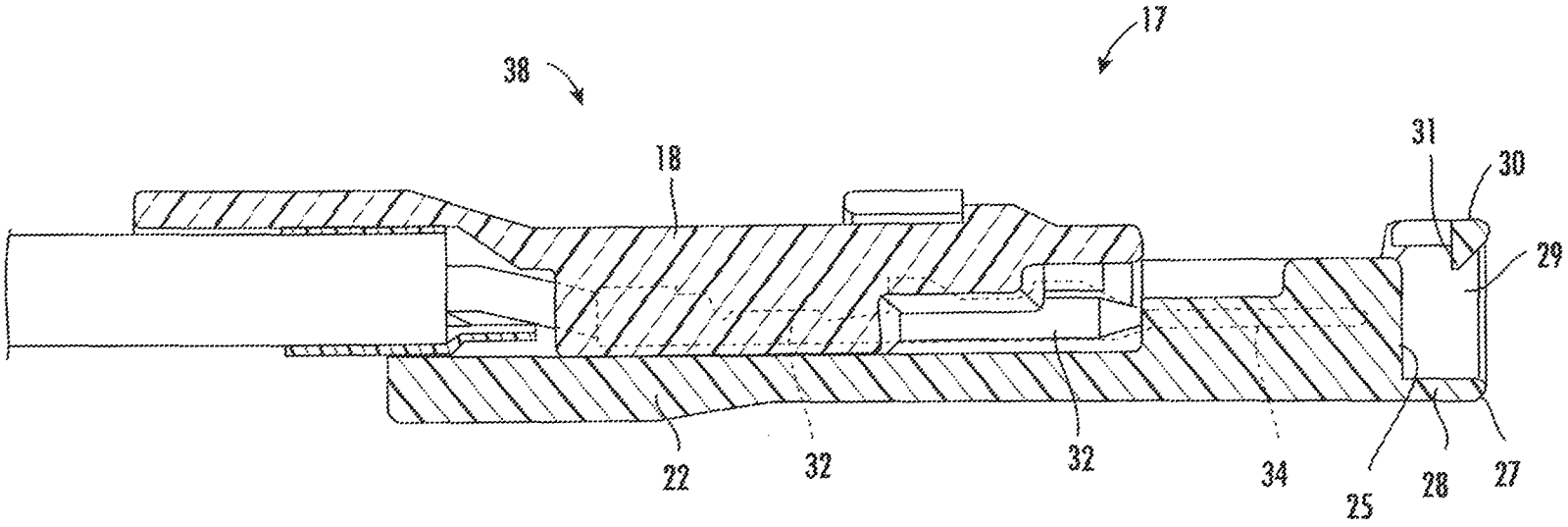
FIG. 6 is a section along Y-Y of FIG. 5 showing the state where the cover is at the protection position.
Figure 7:
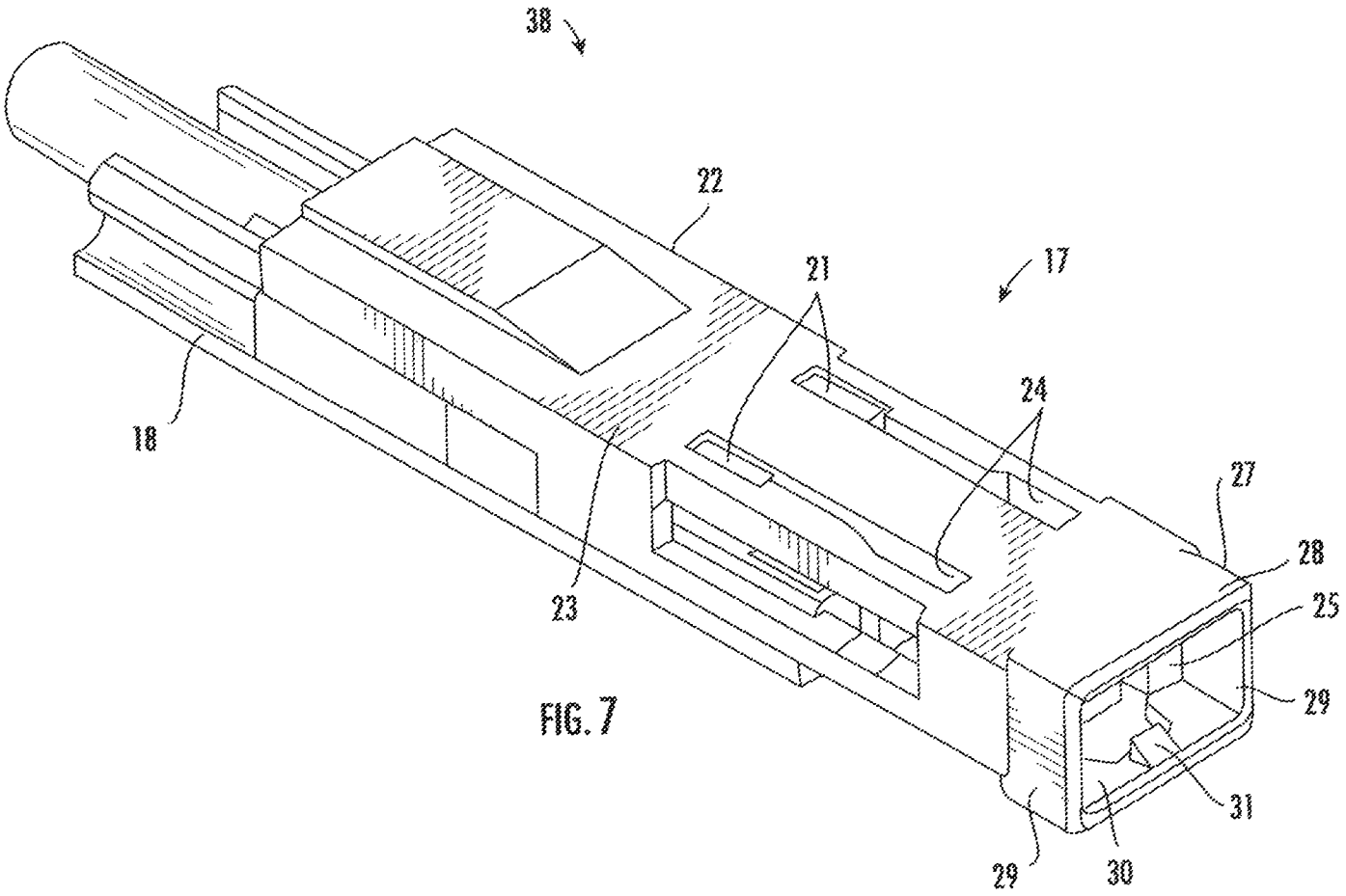
FIG. 7 is a perspective view of the male side dielectric showing the state where the cover is at the protection position in a vertically inverted manner.

As shown in FIGS. 4 and 6, a front area of the cover 22 projects farther forward than the front end of the holder 18 with the cover 22 held at the protection position PP. With the cover 22 held at the protection position PP, the restricting projections 21 are fit to wide parts on rear end parts of the restricting grooves 24, as shown in FIG. 7, thereby restricting a rearward movement of the cover 22 toward the retracted position RP. With the cover 22 held at the retracted position RP, the restricting projections 21 are fit to wide parts on front ends of the restricting grooves 24, as shown in FIG. 8, thereby restricting a forward movement of the cover 22 toward the protection position PP (front side).

A front wall 25 is formed on a front part of the cover 22 and has left and right escaping recesses 26. With the cover 22 held at the protection position PP, the front wall 25 is at a position separated forward from the front end of the holder 18. With the cover 22 held at the retracted position RP, the rear surface of the front wall 25 is in contact with the front end surface of the holder 18.

A frame 27 having a wide rectangular shape in a front view is formed before the front wall 25 on the front end part of the cover 22. The frame 27 functions as a positioning portion for positioning the cover 22 in the vertical and lateral directions with respect to a female side dielectric 45 to be described later and is integral to the cover 22. A lower plate 28 and both left and right side plates 29 of the frame 27 are connected to a lower edge part and both left and right side edge parts of the outer peripheral edge of the front wall 25 and project forward from the lower edge part and the left and right side edge parts.

An upper plate 30 of the frame 27 couples the upper end edges of the left and right side plates 29. A rear edge part of the upper plate 30 is bent such that a laterally central part is concave forward. Left and right ends of the upper plate 30 are connected directly to the upper end edge of the front wall 25, but the laterally central part of the upper plate 30 is not connected directly to the front wall 25. A locking projection 31 (locking portion as claimed) projects down in a laterally central part of the lower surface of the upper plate 30 (inner surface of the frame 27). A formation area of the locking projection 31 in the front-rear direction is only a front area of the frame 27, i.e. an area forward of the front surface of the front wall 25.

<Male Terminal Fittings 32>

The male terminal fitting 32 is formed by applying bending and the like to a long narrow metal plate stamped into a predetermined shape. As shown in FIG. 3, the male terminal fitting 32 includes the terminal body 33, a long and narrow tab 34 projecting forward from the terminal body 33 and a crimping portion 35 connected to the rear end of the terminal body 33. The crimping portion 35 is fixed to a coated wire 37 e.g. constituting a twisted pair cable 36.

Left and right male terminal fittings 32 fixed to the twisted pair cable 36 are held in the holder 18. Specifically, the terminal bodies 33 and the crimping portions 35 of the male terminal fittings 32 are accommodated individually in the holding grooves 19 and are positioned with displacements in the lateral direction restricted. Further, the male terminal fittings 32 are held with displacements in the front-rear direction with respect to the holder 18 restricted by fitting the terminal bodies 33 and the crimping portions 35 into the holding fitting portions 20. The openings of the holding grooves 19 in the lower surface are closed by the cover 20 to hold the male terminal fittings 32 so as not to come out downward from the holder 18. With the male terminal fittings 32 held in the holder 18, the coated wires 37 are drawn out rearwardly of the holder 18 and the tabs 34 project forward from the front end of the holder 18.

Figure 16:
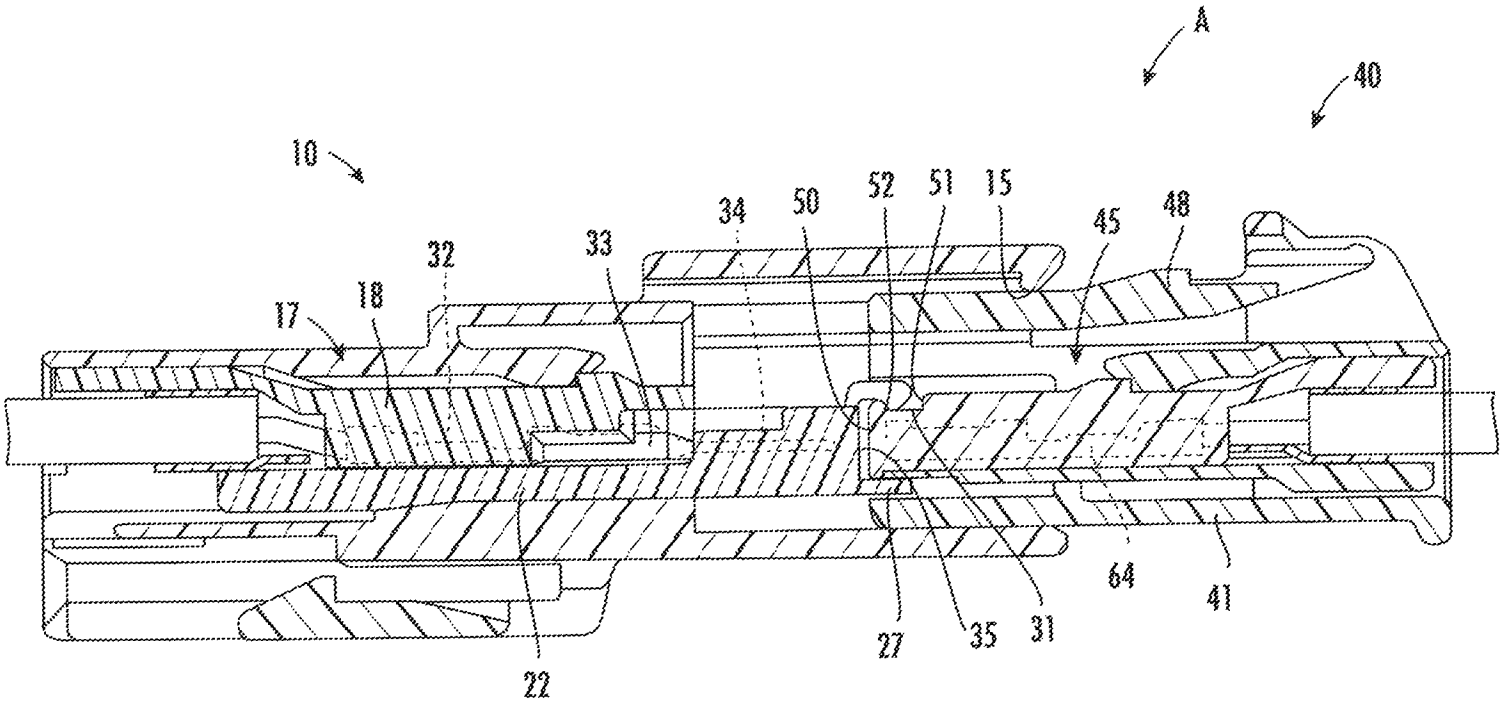
FIG. 16 is a side view in section showing a state where the cover is pulled back to the protection position in the process of separating the male and female connectors.

Front parts of the tabs 34 project forward from the holder 18. However, as shown in FIGS. 3, 6 and 16, the cover 22 that is held at the protection position PP covers front parts of the tabs 34 from below and from left and right sides to prevent interference of external matter. Further, front parts of the tabs 34 are at positions lower than the upper end edges of both side walls of the cover 22, and therefore also are protected from external matter approaching from above. Additionally, the tabs 34 penetrate through the escaping recesses 26 with the cover 22 moved to the retracted position RP. As shown in FIGS. 8 and 9, at the retracted position RP, the front end parts of the tabs 34 are exposed forward from the front wall 25 of the cover 22 and project farther forward than the front end of the frame 27. The front parts of the tabs 34 projecting farther forward than the frame 27 are connected to female terminal fittings 54 (see FIG. 14).

The male dielectric 17 holding the male terminal fittings 32 constitutes a male dielectric module 38. The male dielectric module 38 is inserted into the male accommodating portion 12 from behind the male housing 11, butts against the front stop (not shown) to be stopped in front, is locked by the resiliently deflectable locking lance 14 to be held with displacements restricted with respect to the male housing 11. With the male dielectric 17 mounted in the male housing 11, the front surface of the holder 18 is disposed at the same position as the front end surface of the male accommodating portion 12 (back end surface of the receptacle 13) in the front-rear direction. Thus, at least the front part of the cover 22 projects farther forward than the front end surface of the male accommodating portion 12 and is surrounded by the receptacle 13.

<Female Connector 40>

Figure 11:
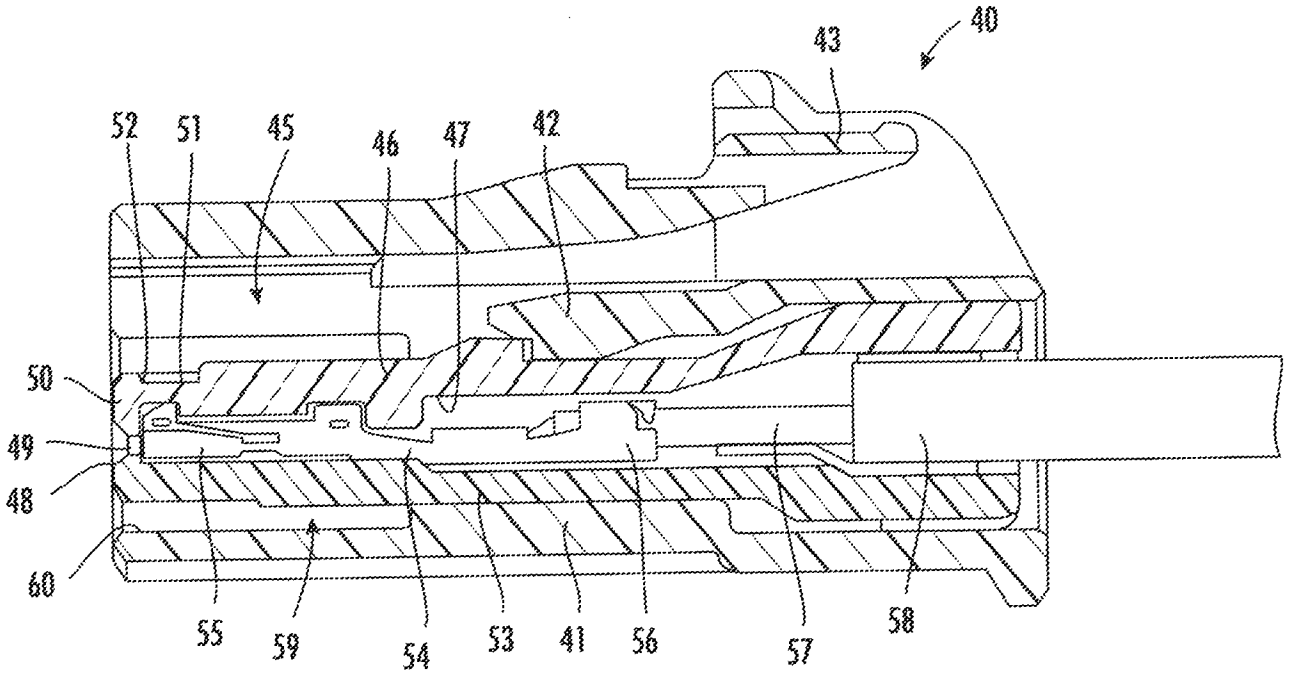
FIG. 11 is a section along Z-Z of FIG. 10.

The female connector 40 is formed by assembling a female housing 41 made of synthetic resin, the female dielectric 45 and left and right female terminal fittings 54. As shown in FIGS. 1 and 11, the female housing 41 is in the form of a block long in the front-rear direction. The female dielectric 45 is inserted into a female side accommodating portion from behind the female housing 41. A front stop (not shown) and a resiliently deflectable locking lance 42 are formed inside the female accommodating portion 12. A lock arm 43 is formed on an outer surface of the female housing 41.

<Female Dielectric 45>

Figure 12:
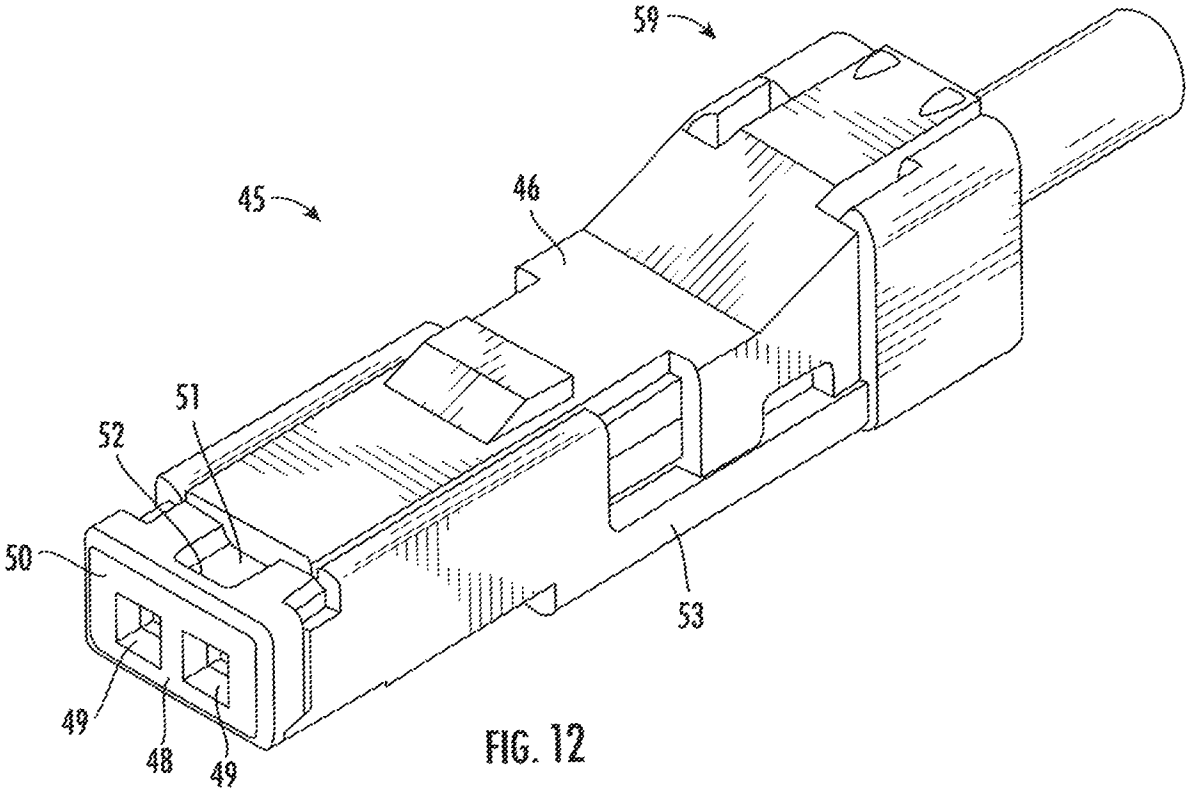
FIG. 12 is a perspective view of a female side dielectric.

The female dielectric 45 is separate from the female housing 41 and is formed by assembling an upper case 46 made of synthetic resin and a lower case 53 made of synthetic resin. As shown in FIGS. 11 and 12, the upper case 46 is a box long in the front-rear direction and open in lower and rear surfaces. Left and right groove-like holding portions 47 are formed in the upper case 46 and are long and narrow in the front-rear direction. A pushing wall 48 is formed on a front part of the upper case 46 and is formed with left and right through holes 49. The lower case 53 is assembled with the upper case 46 to close the lower surface of the upper case 46. The female dielectric 45 functions as a terminal accommodating portion for accommodating the female terminal fittings 54.

The entire pushing wall 48 and a front part of an upper wall of the upper case 46 function as a pushing portion 50 for pushing the cover 22 at the protection position PP to the retracted position RP in the process of connecting the connectors 10, 40. The pushing portion 50 (pushing wall 48) is fit into the frame 27 of the male side dielectric 17 in the process of connecting the connectors 10, 40 to restrict relative displacements in the vertical and lateral directions with respect to the frame 27. Thus, the frame 27 and the pushing portion 50 also function as a positioning portion for positioning the female dielectric 45 and the cover 22 while restricting displacements in two-dimensional directions intersecting a connecting direction of the connectors 10, 40.

As shown in FIGS. 11 and 12, a locking recess 51 (lock, locking target as claimed) is formed in a front end part of the pushing portion 50. The locking recess 51 is formed by recessing a laterally central part of the upper surface (outer surface) of the upper wall of the upper case 46 out of the pushing portion 50. The locking recess 51 has a substantially rectangular shape in a plan view. A lateral dimension (width) of the locking recess 51 is equal to or slightly larger than that of the locking projection 31. A dimension of the locking recess 51 in the front-rear direction is equal to or slightly larger than that of the locking projection 31 in the front-rear direction. A front edge of the opening edge of the locking recess 51 serves as a locking edge 52 lockable to the locking projection 31.

<Female Terminal Fittings 54>

The female terminal fitting 54 is long and narrow in the front-rear direction and is formed by applying bending, folding and/or embossing to a metal plate material stamped into a predetermined shape. As shown in FIG. 11, the female terminal fitting 54 includes a rectangular tubular body 55 and a crimping portion 56 connected behind the rectangular tubular body 55. The crimping portion 56 is fixed to a coated wire 58 constituting a twisted pair cable 57. Left and right female terminal fittings 54 fixed to the twisted pair cable 57 are mounted in the female dielectric 45 while being individually accommodated in the groove-like holding portions 47. With the female terminal fittings 54 mounted in the female dielectric 45, the coated wires 58 are drawn out rearwardly of the female dielectric 45.

The female side dielectric 45 holding the two female terminal fittings 54 constitutes a female dielectric module 59. The female dielectric module 59 is inserted into the female housing 41 (e.g. from behind), butts against the front stop (not shown) to be stopped in front, locked and retained by the resiliently deflectable locking lance 42, and held with displacements relative to the female housing 41 restricted. With the female dielectric 45 mounted in the female housing 41, the front surface of the pushing portion 50 is disposed at the same position as that of the female housing 41 in the front-rear direction. Further, an escaping groove 60 for avoiding interference with the frame 27 is formed in a rectangular frame area surrounding the pushing portion 50.

Functions and Effects of First Embodiment

Immediately after the male terminal fittings 32 are mounted into the male dielectric 17, the cover 22 is moved to the protection position PP, as shown in FIGS. 4, 6 and 7. The coverage provided by the cover 22 protects the tabs 34 from damage due to the interference of external matter. The male dielectric module 38 is assembled with the male housing 11 with the cover 22 kept at the protection position PP.

Figure 13:
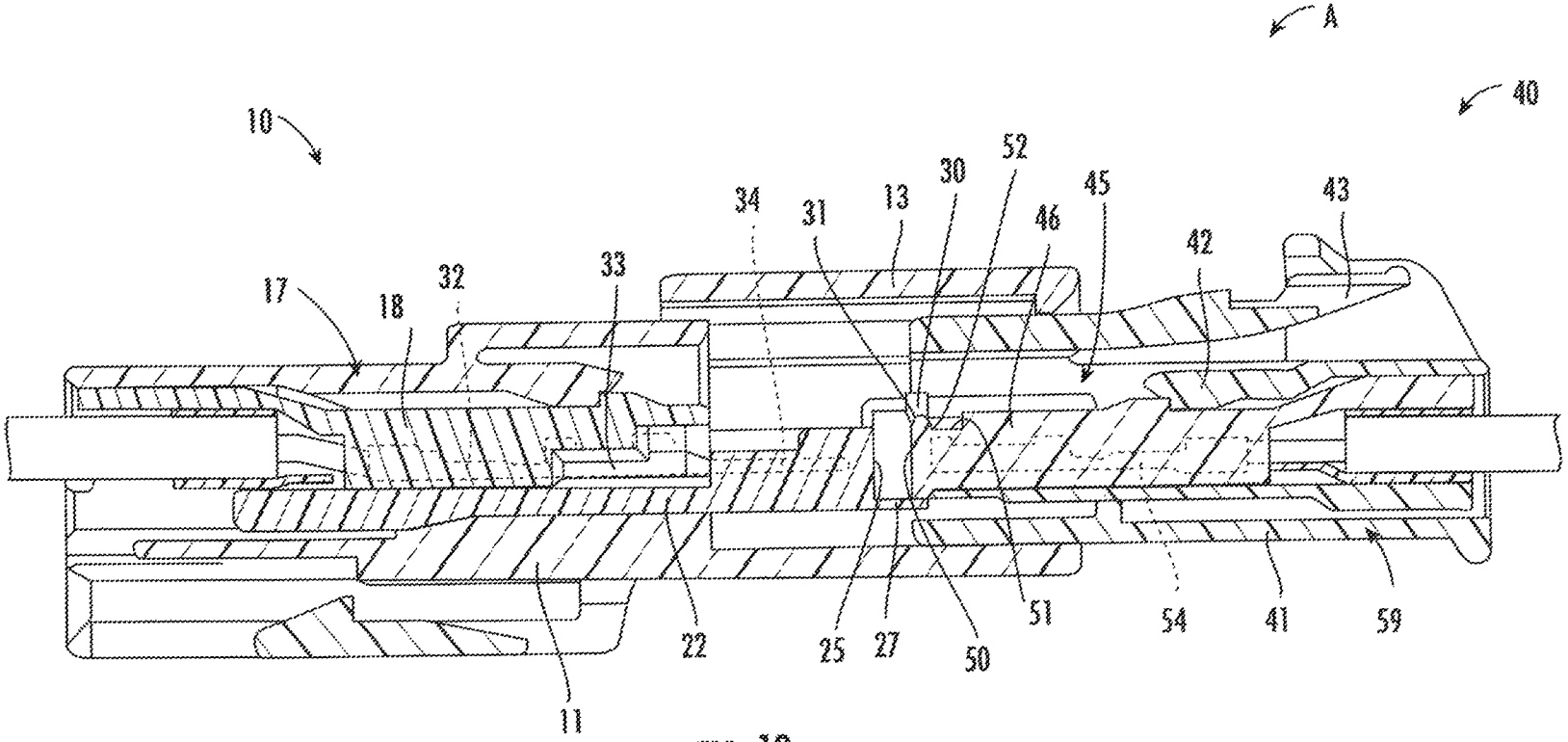
FIG. 13 is a side view in section showing an initial state of connection of the male and female connectors.

The female housing 41 is fit into the receptacle 13 of the male housing 11 to connect the connectors 10, 40. More particularly, the pushing portion 50 of the female dielectric 45 is fit into the frame 27 of the male side dielectric 17 and the cover 22 and the female side dielectric 45 are positioned in the vertical and lateral directions. In the process of fitting the pushing portion 50 into the frame 27, the locking projection 31 interferes with the front end part of the pushing portion 50, but the cover 22 is held at the protection position PP by the locking of the restricting grooves 24 and the restricting projections 21. Thus, as shown in FIG. 13, the upper plate 30 of the frame 27 is displaced resiliently up.

When the locking projection 31 passes through an interfering part of the pushing portion 50, the upper plate 30 resiliently returns downward and the locking projection 31 is accommodated into the locking recess 51. Also, after the locking projection 31 passes through the interfering part, the frame 27 and the pushing portion 50 are fit slightly farther and the front surface of the pushing portion 50 butts into surface contact with the front surface of the front wall 25 of the cover 22. In this way, a fitting operation of the frame 27 and the pushing portion 50 is completed. With the cover 22 and the pushing portion 50 butted against each other, a clearance is formed in the front-rear direction (direction parallel to the connecting/separating direction of the connectors 10, 40) between the locking projection 31 and the locking edge 52 of the locking recess 51 so that the locking projection 31 and the locking edge 52 are not locked to each other.

Figure 14:
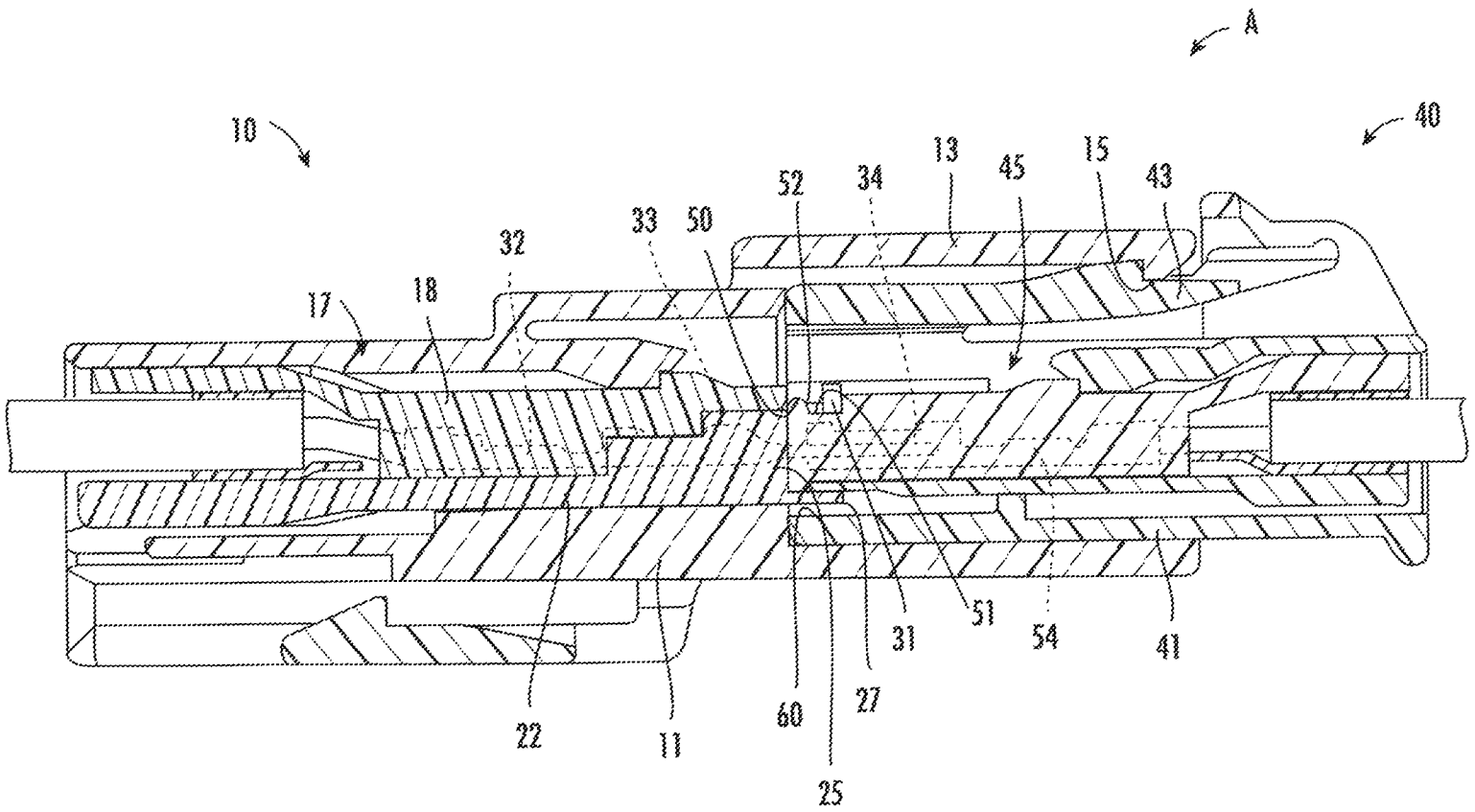
FIG. 14 is a side view in section showing a properly connected state of the male and female connectors.
Figure 15:
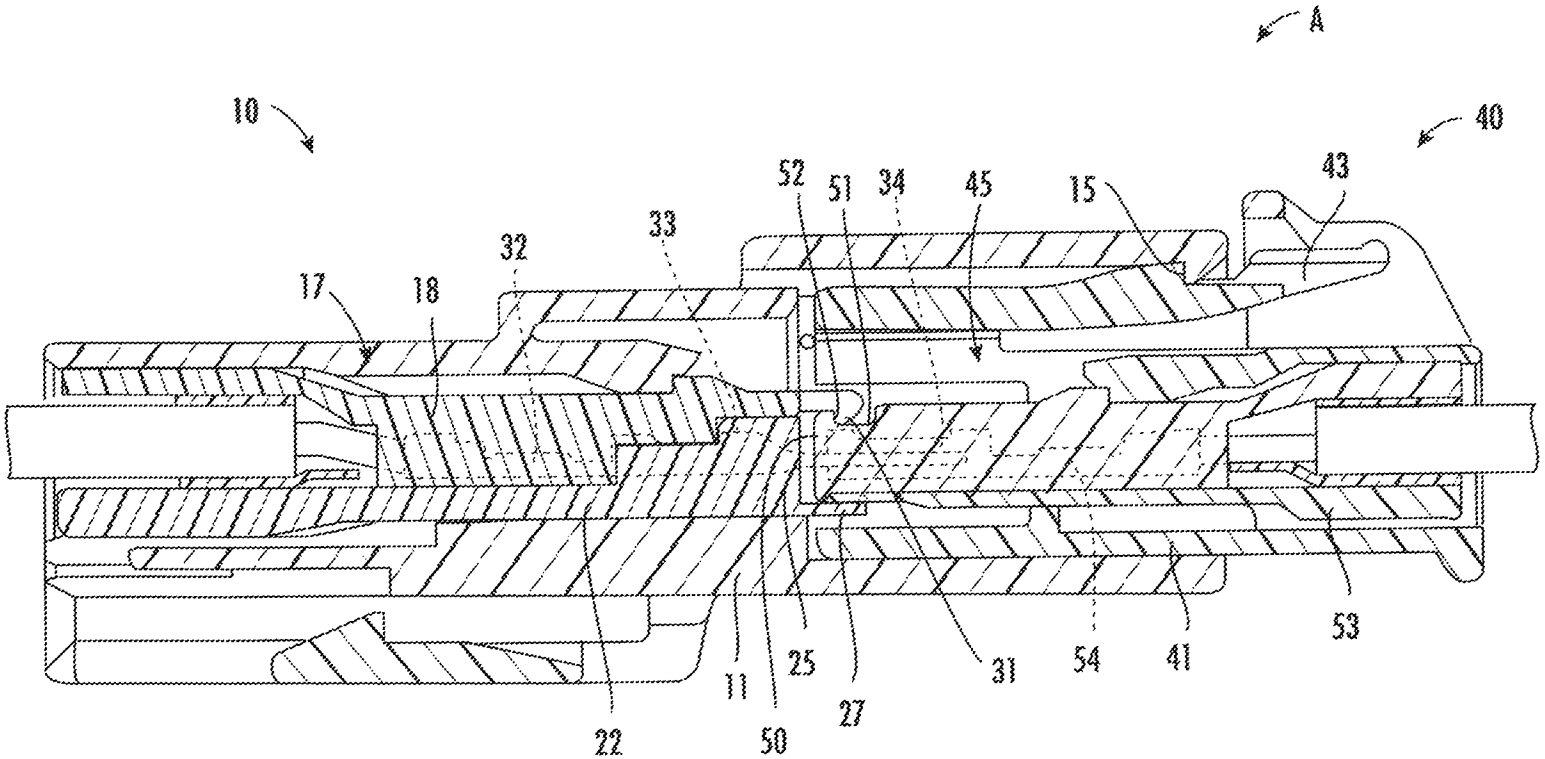
FIG. 15 is a side view in section showing a state where a locking projection of the male side dielectric and a locking edge part of the female side dielectric are locked after the start of separation of the male and female connectors.

Also after the fitting of the frame 27 and the pushing portion 50 is completed, a connecting operation of the connectors 10, 40 proceeds and the restricting projections 21 and the restricting grooves 24 are released from a semi-locked state by a pressing force of the female dielectric 45 (pushing portion 50) to the cover 22. In this way, as the connectors 10, 40 are connected, the cover 22 moves integrally with the female side dielectric 45 and is pushed toward the retracted position RP. When the connectors 10, 40 reach a properly connected state, the lock arm 43 and the lock projection 15 are locked, as shown in FIG. 14, to hold the connectors 10, 40 in the connected state.

When the connectors 10, 40 are connected properly, the cover 22 reaches the retracted position RP. In the process of sliding the cover 22 from the protection position PP to the retracted position RP (in the process of connecting the connectors 10, 40), the tabs 34 are exposed forward of the cover 22. The tabs 34 gradually are exposed more as the connecting operation proceeds. Along with this, the tabs 34 pass through the through holes 49 of the pushing portion 50 (pushing wall 48) to enter the female dielectric 45. Thus, a connecting operation of the tabs 34 and the female terminal fittings 54 proceeds. When the connectors 10, 40 reach the properly connected state, the male terminal fittings 32 and the female terminal fittings 54 are connected properly.

To separate the connectors 10, 40 in the connected state, the lock arm 43 is displaced to an unlocking state and separated from the lock projection 15, and the housings 11, 41 are pulled apart while keeping this unlocked state. In an initial stage of the process of separating the connectors 10, 40, the female dielectric 45 moves integrally with the female housing 41 away from the male housing 11 and the male dielectric 17, as shown in FIG. 14. During this time, the cover 22 and the female dielectric 45 are displaced relatively to eliminate the clearance and the locking projection 31 contacts and locks the locking edge 52.

The locking of the locking projection 31 and the locking edge 52 in the process of separating the connectors 10, 40 enables the cover 22 to displace integrally with the female dielectric 45 toward the protection position PP while moving away from the holder 18. Movement of the cover 22 away from the holder 18 releases the restricting projections 21 and the restricting grooves 24 from the semi-locked state. When the cover 22 reaches the protection position PP, as shown in FIG. 16, the restricting projections 21 butt against the rear ends of the restricting grooves 24. Thus, the cover 22 cannot move away from the holder 18 any farther. Therefore, after the cover 22 reaches the protection position PP, the locking of the locking projection 31 and the locking edge 52 is released and the female housing 41 is separated from the cover 22.

The connector device A of the first embodiment includes the male connector 10, the male terminal fittings 32 and the male dielectric 17. The male terminal fittings 32 have the tabs 34 projecting forward from the terminal bodies 33. The male dielectric 17 includes the holder 18 for holding the terminal bodies 33 of the male terminal fittings 32, and the cover 22 mounted on the holder 18. The cover 22 is slidable between the protection position PP for covering the tabs 34 and the retracted position RP retracted rearward from the protection position PP to expose the front ends of the tabs 34.

The connector device A of the first embodiment includes the female connector 40 connectable to the male connector 10, the female terminal fittings 54 that are configured to be connected to the tabs 34 by connecting the connectors 10, 40, and the pushing portion 50. The pushing portion 50 functions to push the cover 22 from the protection position PP to the retracted position RP in the process of connecting the female connector 40 to the male connector 10.

Further, the cover 22 is formed with the locking projection 31, and the female connector 40 is formed with the locking recess 51. In the process of separating the female connector 40 from the male connector 10, the locking projection 31 and the locking edge 52 of the locking recess 51 are locked together so that the female connector 40 (female dielectric 45) displaces the cover 22 from the retracted position RP to the protection position PP. Thus, an operation of pulling back or displacing the cover 22 from the retracted position RP to the protection position PP is not necessary after the connectors 10, 40 are separated, and work efficiency is excellent.

Further, the connector device A of the first embodiment includes the female dielectric 45 constituting the female connector 40 and functioning as the terminal accommodating portion for accommodating the female terminal fittings 54. The front part of the cover 22 is formed with the frame 27 functioning as the positioning portion, and the front part of the female dielectric 45 is formed with the pushing portion 50 functioning as the positioning portion. In the process of connecting the male connector 10 and the female connector 40, the inner periphery of the frame 27 and the outer periphery of the pushing portion 50 are fit together, thereby restricting relative displacements of the cover 22 and the female side dielectric 45 in directions intersecting the connecting direction.

According to this configuration, in the process of connecting the male and female connectors 10 and 40, the female dielectric 45 accommodating the female terminal fittings 54 is positioned with respect to the cover 22. Since the cover 22 is assembled with the holder 18 holding the terminal bodies 33 of the male terminal fittings 32, the male terminal fittings 32 and the female terminal fittings 54 can be positioned and connected smoothly.

Further, the pushing portion 50 functions to push the cover 22 at the protection position PP toward or to the retracted position RP in the process of connecting the connectors 10, 40, and also functions as the positioning portion by being fit to the frame 27. Thus, the structure of the female side dielectric 45 can be simplified in the female connector 40 of the first embodiment as compared to the case where a positioning portion is formed at a location different from the pushing portion 50.

Further, the locking projection 31, functioning as a lock, is formed on the inner surface of the frame 27, and the locking recess 51, functioning as a lock, is formed in the outer surface of the pushing portion 50. Since the frame 27 formed with the locking projection 31 functions as a positioning portion in cooperation with the pushing portion 50, the frame 27 serving as the positioning portion also functions as the lock. Therefore, the shape of the cover 22 can be simplified in the male dielectric 17 of the first embodiment as compared to the case where a positioning portion is formed at a location different from the lock.

Further, in a state where the connectors 10, 40 are connected properly and the pushing portion 50 is in contact with the cover 22, the locking projection 31 of the cover 22 and the locking edge 52 of the female connector 40 are not in contact. Thus, the cover 22 and the female connector 40 are relatively displaceable in the separating direction. By relative displacements of the cover 22 and the female connector 40 (female dielectric 45) in the separating direction, the locking projection 31 and the locking edge 52 are locked. By positioning the locking projection 31 and the locking edge 52 as described above, the locking projection 31 of the cover 22 and the locking edge 52 of the female connector 40 can be locked reliably when the connectors 10, 40 are separated even if dimensional tolerances and assembling tolerances of members constituting the male connector 10 and the female connector 40 are large.

Second Embodiment

Next, a second embodiment of the invention is described with reference to FIGS. 17 to 20. A connector device B of the second embodiment differs from the first embodiment in the shape of a cover 71 of a male side dielectric 70 and the shapes of a pushing portion 76 of a female side dielectric 75 and parts near the pushing portion 76. Since other components are the same as in the above first embodiment, the same components are denoted by the same reference signs and the structures, functions and effects thereof are not described.

Figure 17:
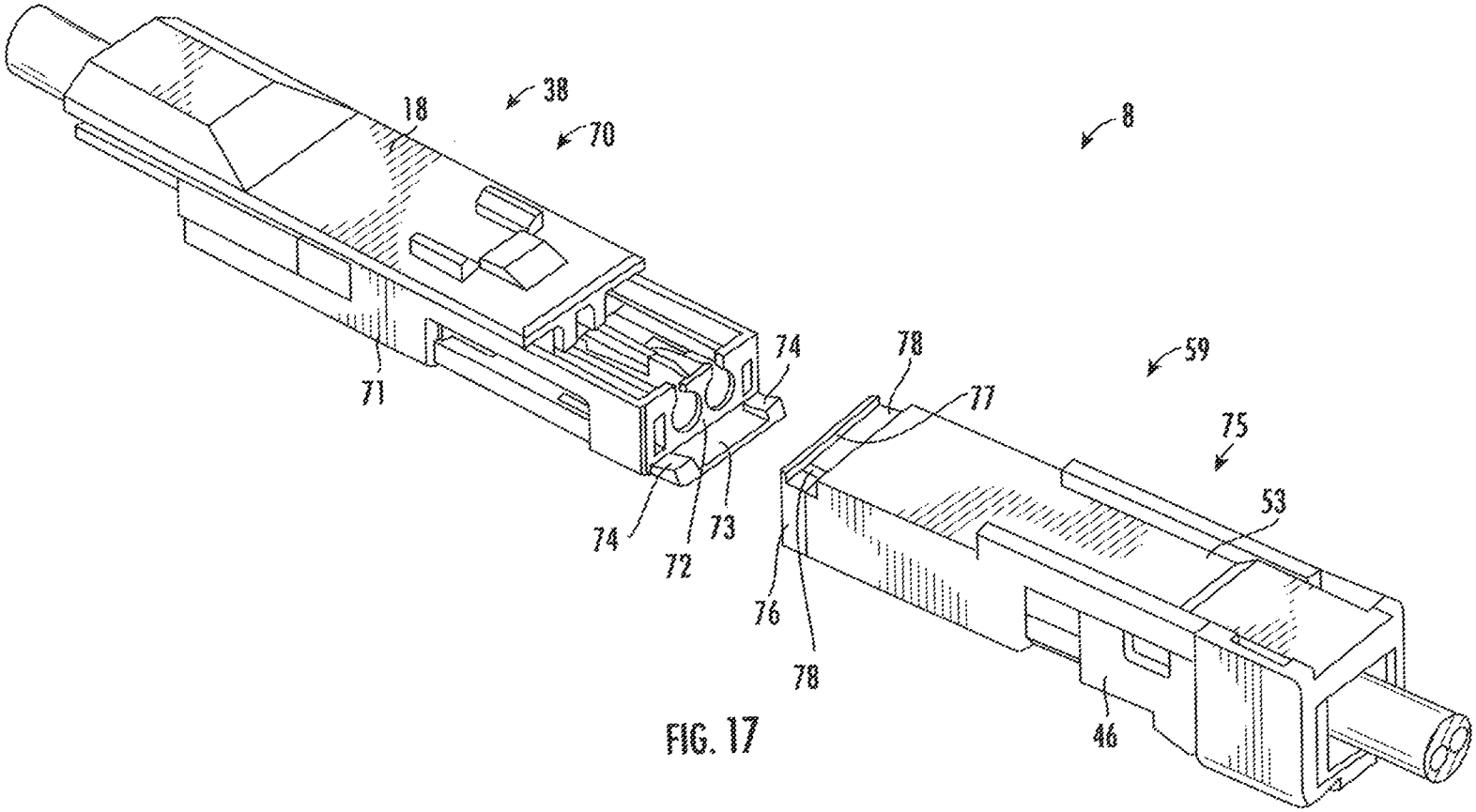
FIG. 17 is a perspective view showing a state where a made side dielectric and a vertically inverted female side dielectric are separated and opposed in a connector device of a second embodiment.
Figure 18:
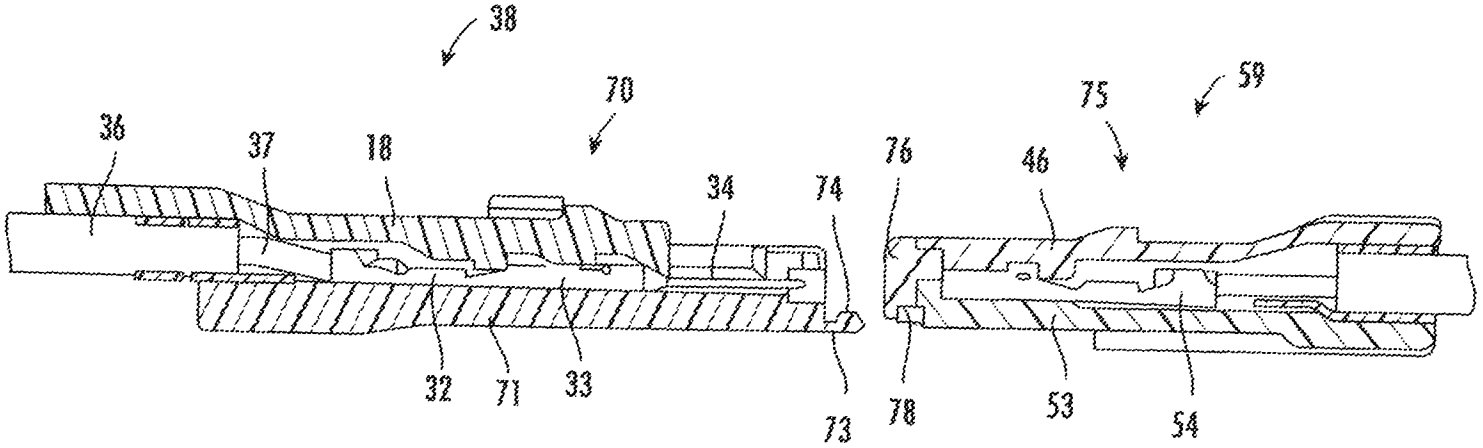
FIG. 18 is a side view in section showing a separated state of the male and female side dielectrics.
Figure 19:
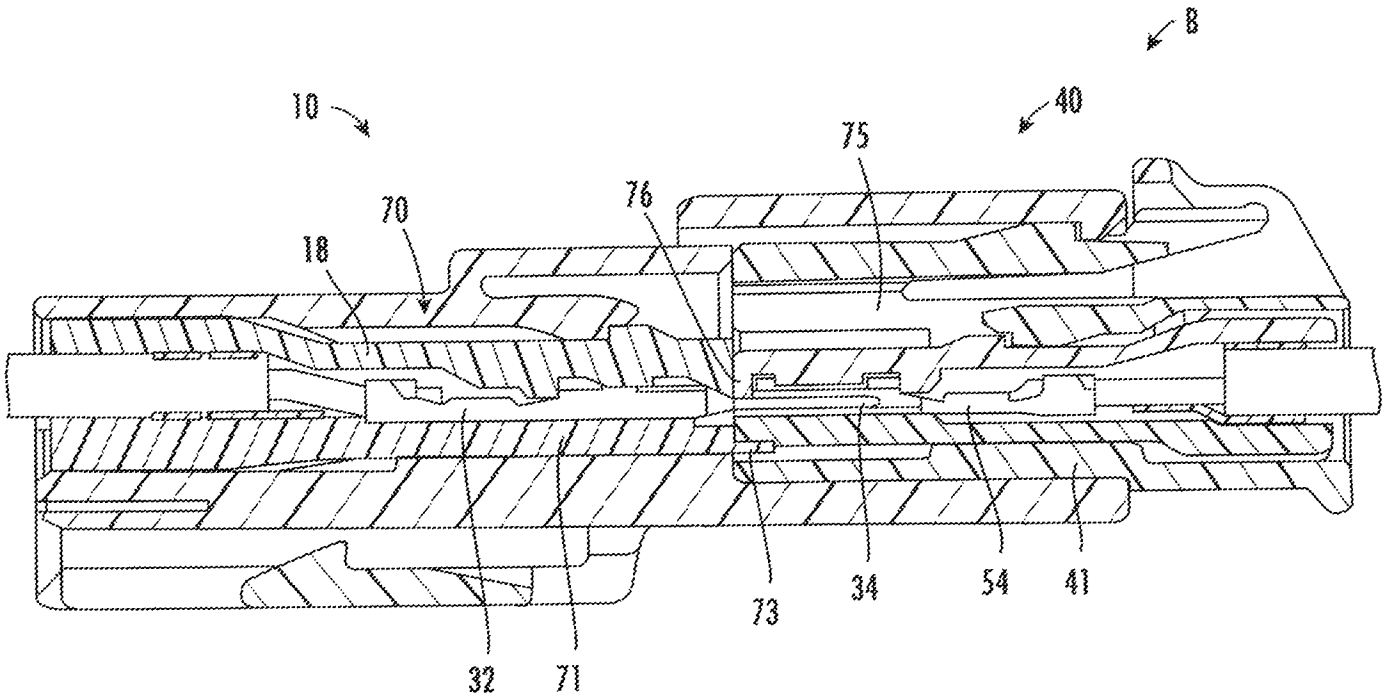
FIG. 19 is a side view in section showing a state where a male connector and a female connector are properly connected.
Figure 20:
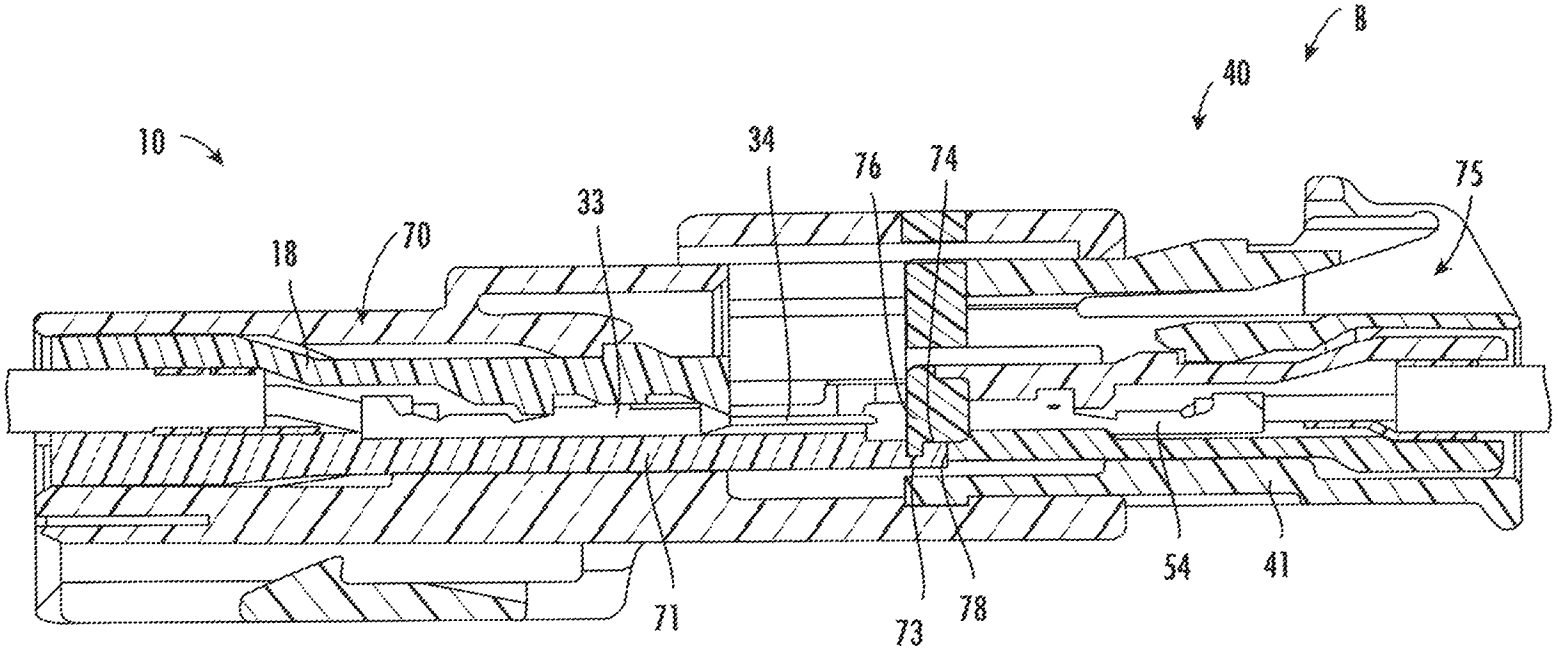
FIG. 20 is a side view in section showing a state where a cover is pulled back to a protection position in the process of separating the male and female connectors.

As shown in FIG. 17, a front part of the cover 71 of the male dielectric 70 has neither the frame 27 functioning as the positioning portion nor the locking projection 31 functioning as the lock in the first embodiment. The front part of the cover 71 has a rib 73 projecting forward from a lower edge of a front wall 72. Two functional projections 74 (lock and positioning portion as claimed) project up on left and right end parts of the rib 73. As shown in FIG. 17, a stepped recess 77 is formed in a front part of the female dielectric 75 by recessing a lower edge of the pushing portion 76. Functional recesses 78 (locking target, positioning portion as claimed) are formed on left and right ends of the stepped recess 77.

When the pushing portion 76 pushes the cover 71 from a protection position to a retracted position in the process of connecting a male connector 10 and a female connector 40, the rib 73 and the stepped recess 77 are fit and the left and right functional projections 74 and left and right functional recesses 78 are fit. By fitting the rib 73 and the stepped recess 77, relative upward displacements of the rib 73 and the stepped recess 77 with respect to a front part of the cover 71 and the front part (pushing portion 76) of the female side dielectric 75 are restricted. Further, by locking the functional projections 74 and the functional recesses 78, the separation of the front part of the cover 71 and the front part (pushing portion 76) of the female side dielectric 75 in a front-rear direction is restricted and these front parts are positioned in a lateral direction. Further, in the process of separating the connectors 10, 40, the female connector 40 pulls back the cover 71 at the retracted position to the protection position by the locking of the functional projections 74 and the functional recesses 78.

Third Embodiment

Next, a third embodiment of the present invention is described with reference to FIGS. 21 to 24. A connector device C of the third embodiment differs from the first embodiment in locking projections 82 (lock as claimed) formed on a cover 81 of a male dielectric 80 and locking recesses 85 (lock, locking target as claimed) formed in a pushing portion 84 of a female dielectric 83. Since other components are the same as in the above first embodiment, the same components are denoted by the same reference signs and the structures, functions and effects thereof are not described.

Figure 21:
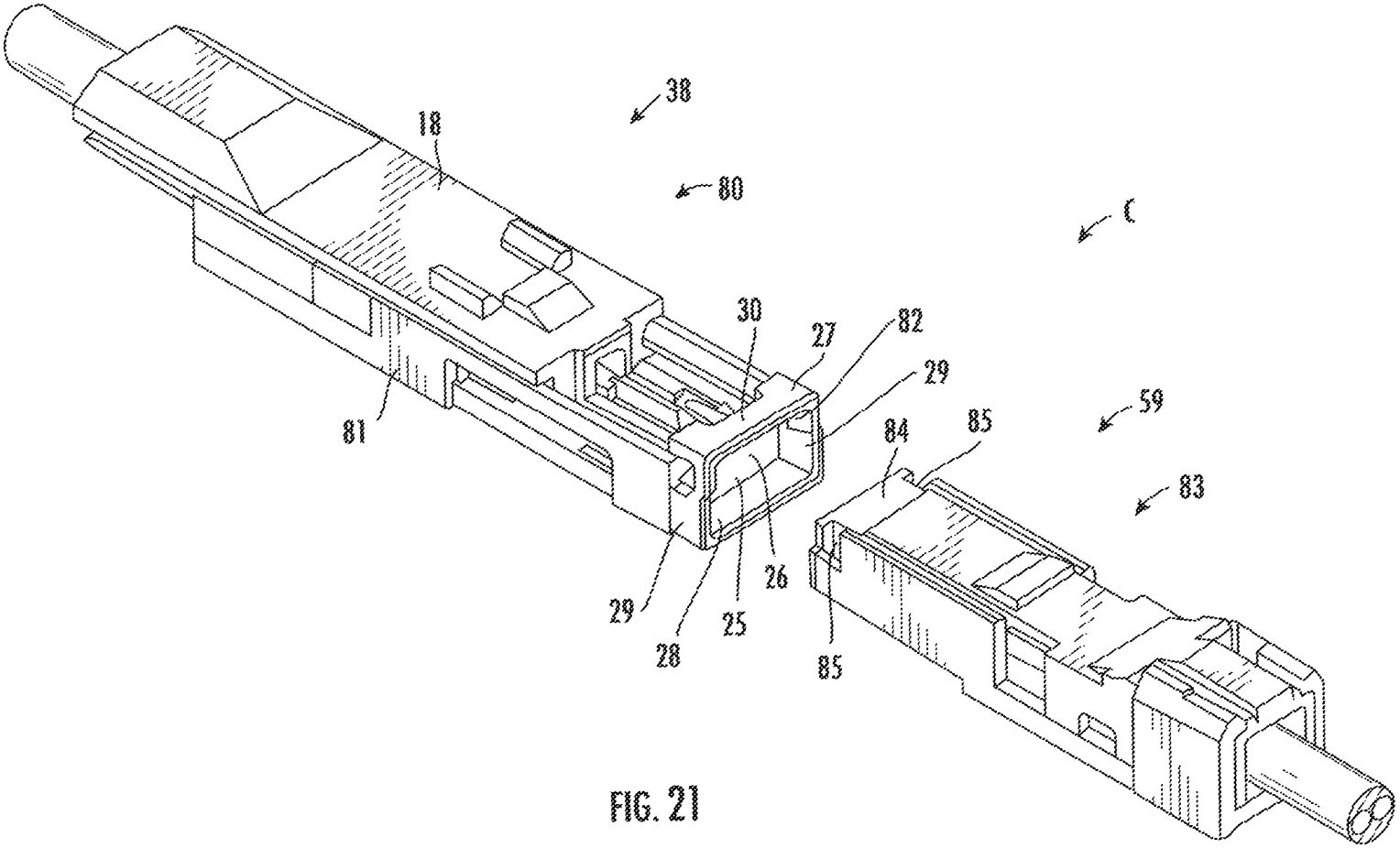
FIG. 21 is a perspective view showing a state where a male side dielectric and a female side dielectric are separated in a connector device of a third embodiment.
Figure 22:
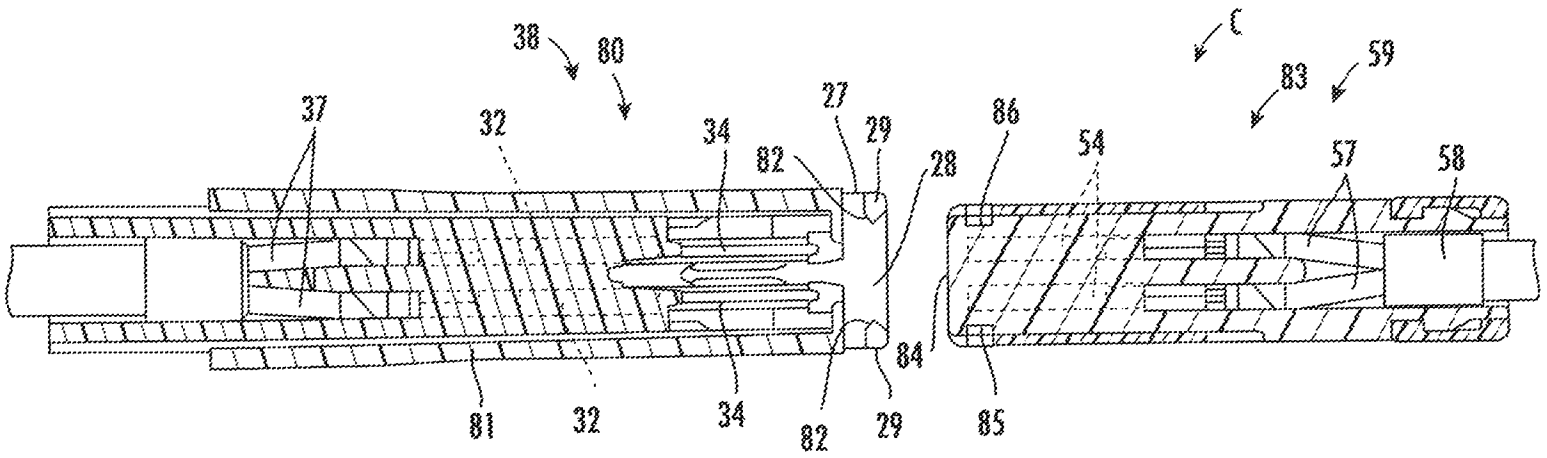
FIG. 22 is a plan view in section showing a state where the male and female side dielectrics are separated.
Figure 23:
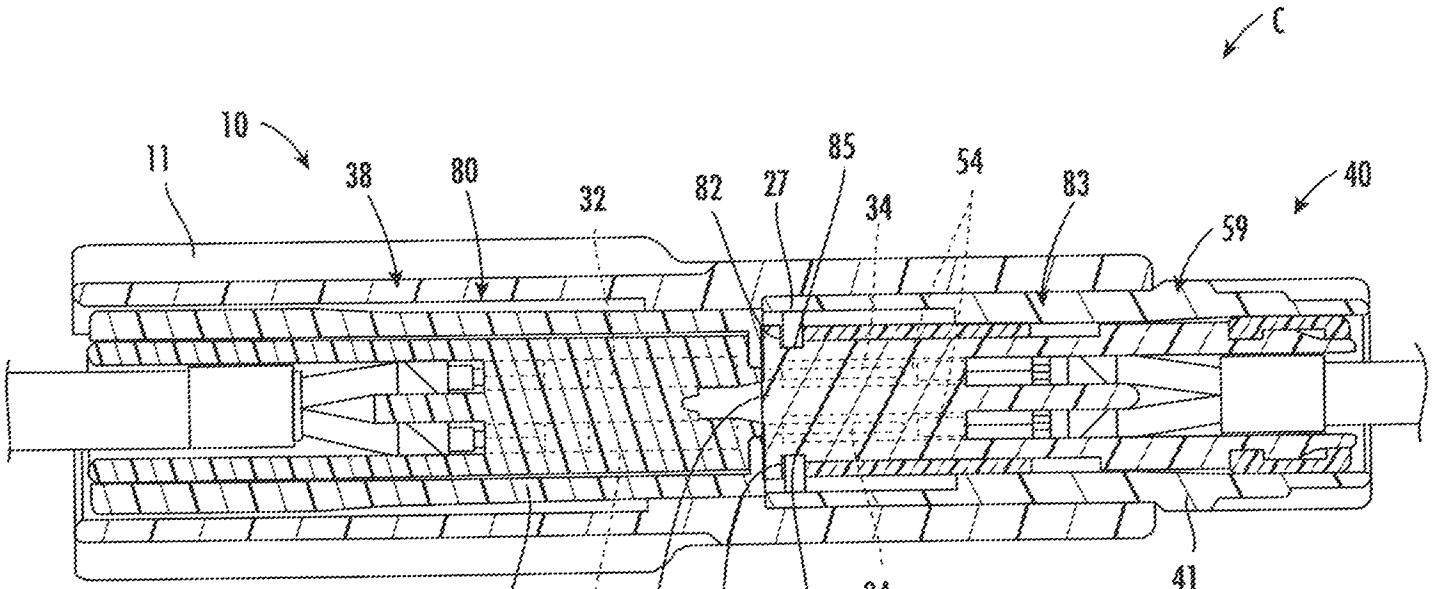
FIG. 23 is a plan view in section showing a state where a male connector and a female connector are properly connected.
Figure 24:
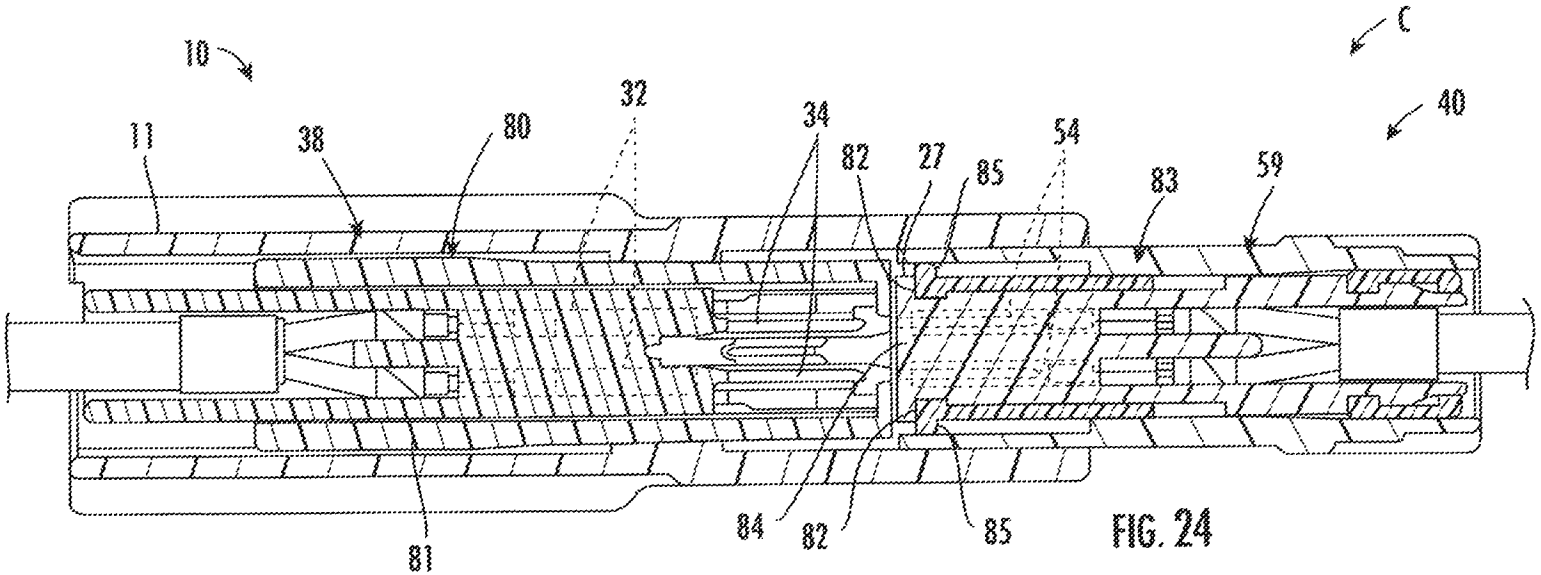
FIG. 24 is a plan view in section showing a state where a cover is pulled back to a protection position in the process of separating the male and female connectors.

Although the locking projection 31 is formed on the inner surface of the upper plate 30 constituting the frame portion 27 in the above first embodiment, the locking projections 82 of the third embodiment are formed on upper end parts of the inner surfaces of both left and right side plate portions 29 constituting a frame 27, as shown in FIGS. 21 and 22. Further, although the locking recess 51 is formed in the upper surface of the pushing portion 50 in the first embodiment, the locking recesses 85 of the third embodiment are formed in upper parts of both left and right outer side surfaces of the pushing portion 84.

When the pushing portion 84 pushes the cover 81 from a protection position to a retracted position in the process of connecting a male connector 10 and a female connector 40, the frame 27 and the pushing portion 84 are fit and positioned in vertical and lateral directions, and left and right locking projections 82 and left and right locking recesses 85 are locked. Further, in the process of separating the connectors 10, 40, the cover 81 at the retracted position is pulled back to the protection position by locking the locking projections 82 and the locking recesses 85.

The invention is not limited to the above described embodiments, and the following embodiments also are included in the scope of the invention.

Although the male dielectric is formed by assembling the cover with the holder functioning as the terminal holding portion and this male dielectric is mounted into the male housing in the first to third embodiments, the terminal holding portion may be formed integrally or unitarily to the male housing.

Although the female dielectric formed with the pushing portion is mounted into the female housing in the first to third embodiments, the pushing portion may be formed integrally or unitarily to the female housing.

Although the cover is formed with the frame serving as the positioning portion in the above first to third embodiments, the terminal accommodating portion (female dielectric) may be formed with the frame serving as the positioning portion.

Although the cover and the terminal accommodating portion are formed with the positioning portions in the above first to third embodiments, such positioning portions may not be formed.

REFERENCE SIGNS

A, B, C connector device
10 . . . male connector
18 holder (terminal holding portion)
22, 71, 81 . . . cover
27 . . . frame (positioning portion)
31, 82 . . . locking projection (lock)
32 . . . male terminal fitting
33 . . . terminal body
34 . . . tab
40 . . . female connector
45, 83 . . . female dielectric (terminal accommodating portion)
50, 76, 84 . . . pushing portion (positioning portion)
51, 85 . . . locking recess (lock, locking target)
53 . . . female terminal fitting
74 . . . functional projection (lock, positioning portion)
78 . . . functional recess (lock, locking target, positioning portion)

What is claimed is:

1. A connector device, comprising:

a male connector;

at least one male terminal fitting being part of the male connector, the male terminal fitting having a tab substantially projecting forward from a terminal body portion and having a leading end;

a terminal holding portion being part of the male connector, the terminal holding portion being capable of holding the terminal body portion;

a cover to be mounted on the terminal holding portion, a frame that is formed as a front part of the cover and surrounding the tab, the cover being displaceable between a protection position for where the frame at least partly coverings the tab and a retracted position displaced from the protection position to at least partly expose the leading end of the tab, at least one lock projecting in on the frame;

a female connector connectable to the male connector;

at least one female terminal fitting forming part of the female connector, the female terminal fitting being connectable to the tab by connecting the male connector and the female connector;

at least one pushing portion forming part of the female connector, the pushing portion being configured to be inserted into the frame and to displace the cover from the protection position toward or to the retracted position in the process of connecting the female connector to the male connector; and at least one locking recess formed in an outer surface of the pushing portion and being configured to engage the locks projecting in on the frame and being configured to displace the cover from the retracted position toward or to the protection position by being locked to each other while separating the female connector from the male connector.

2. The connector device of claim 1, further comprising:

at least one terminal accommodating portion; forming part of the female connector, the terminal accommodating portion; being configured to at least partly accommodate the female terminal fitting; and positioning portions formed on the cover and the terminal accommodating portion, the positioning portions being configured to restrict relative displacements of the cover and the terminal accommodating portion; in a direction intersecting a connecting direction by being at least partly fit to each other when connecting the male connector and the female connector.

3. The connector device of claim 2, wherein:

the positioning portions is a comprise the frame; and the pushing portion.

4. The connector device of claim 1, wherein the at least one lock of the cover and the at least one locking recess of the female connector are disposed to allow relative displacements of the cover and the female connector in a separating direction and are disposed in a positional relationship to be lockable to each other by the relative displacements in the separating direction in a state where the male connector and the female connector are connected properly and the pushing portion is in contact with the cover.

5. A male connector connectable to a female connector including a pushing portion and a terminal accommodating portion at least partly accommodating a female terminal fitting, the male connector comprising:

at least one male terminal fitting having a tab projecting forward from a terminal body;

a terminal holding portion configured for holding the terminal body;

a cover mounted on the terminal holding portion, a frame formed on a front part of the cover, the frame being configured to have the pushing portion at least partly fit thereto, the cover further being formed with at least one positioning portion fit on the terminal accommodating portion of the female connector, the positioning portion restricting a relative displacement of the cover with respect to the terminal accommodating portion in a direction intersecting a connecting direction when connecting the male connector and the female connector, the cover being displaceable between a protection position for at least partly covering the tab and a retracted position displaced from the protection position to at least partly expose the tab, the cover being displaced from the protection position toward or to the retracted position by the pushing portion in the process of connecting the female connector to the male connector; and at least one locking projection formed on an inner surface of the cover frame, the locking projection being configured to displace the cover from the retracted position toward or to the protection position by being locked to a locking target on an outer surface of the pushing portion of the female connector while separating the female connector from the male connector.

6. The male connector of claim 5, wherein the locking projection and the locking target allow relative displacements of the cover and the female connector in a separating direction and are disposed in such a positional relationship to be lockable to each other by the relative displacements in the separating direction in a state where the male connector and the female connector are connected properly and the pushing portion is in contact with the cover.

* * * * *